US005766283A

United States Patent [19]

Bumb et al.

[11] Patent Number: 5,766,283

[45] Date of Patent: Jun. 16, 1998

[54] DUST FILTER BAG FOR A VACUUM CLEANER

[75] Inventors: Germann Bumb, Wuppertal; Stephan Peter Dieudonné, Herne; Ludger Helmes, Velbert; Stefan Kraut-Reinkober, Leverkusen; Ralf Sauer, Essen, all of Germany; Bastiaan Schultink, Eksel, Belgium

[73] Assignee: Vorwerk & Co. Interholding GmbH, Wuppertal, Germany

[21] Appl. No.: 652,602

[22] PCT Filed: Dec. 1, 1994

[86] PCT No.: PCT/EP94/03997

§ 371 Date: Aug. 6, 1996

§ 102(e) Date: Aug. 6, 1996

[87] PCT Pub. No.: WO95/15108

PCT Pub. Date: Jun. 8, 1995

[30] Foreign Application Priority Data

| | | | |
|---|---|---|---|
| Dec. 3, 1993 | [DE] | Germany | 43 41 248.3 |
| Sep. 28, 1994 | [DE] | Germany | 44 34 622.0 |
| Sep. 30, 1994 | [DE] | Germany | 44 34 935.1 |

[51] Int. Cl.[6] ..... B01D 46/02

[52] U.S. Cl. ..... 55/367; 15/347; 15/350; 15/352; 55/369; 55/374; 55/378; 55/DIG. 2

[58] Field of Search ..... 55/362, 367, 369, 55/370, 373, 374, 375, 376, 377, 378, DIG. 2, DIG. 3; 15/347, DIG. 8, 350, 351, 352

[56] References Cited

U.S. PATENT DOCUMENTS

| | | | |
|---|---|---|---|
| 2,864,462 | 12/1958 | Brace . | |
| 3,639,939 | 2/1972 | Crener et al. | 15/350 |
| 4,670,937 | 6/1987 | Sumerau et al. | 15/352 |
| 4,724,574 | 2/1988 | Bowerman et al. | 55/373 |
| 4,851,019 | 7/1989 | Ahlf et al. | 55/367 |
| 4,885,013 | 12/1989 | Ahlf et al. | 55/374 |
| 4,961,765 | 10/1990 | Guhne et al. | 55/367 |
| 5,158,635 | 10/1992 | Schmirer et al. | 55/367 |
| 5,221,303 | 6/1993 | Guhne et al. | 55/DIG. 2 |
| 5,468,272 | 11/1995 | Schmierer | 55/367 |
| 5,472,460 | 12/1995 | Schmierer | 55/DIG. 2 |
| 5,472,465 | 12/1995 | Schmierer | 55/DIG. 2 |

FOREIGN PATENT DOCUMENTS

| | | | |
|---|---|---|---|
| 00450036 | 2/1982 | European Pat. Off. . | |
| 0289709 | 11/1988 | European Pat. Off. . | |
| 0510314 | 10/1992 | European Pat. Off. . | |
| 0532057 | 3/1993 | European Pat. Off. . | |
| 2407478 | 8/1974 | Germany . | |
| 3911580 | 11/1989 | Germany . | |
| 3919256 | 12/1990 | Germany . | |
| 4341248 | 6/1995 | Germany . | |
| 2108377 | 5/1983 | United Kingdom | 15/30 |

*Primary Examiner*—Duane Smith
*Attorney, Agent, or Firm*—Martin A. Farber

[57] ABSTRACT

The invention pertains to a filter bag (8) for a vacuum cleaner (1), with a retainer plate (16) made of a cardboard-paper material that can be attached to a dust bag (37), for example by gluing, and that has a sealable opening (19) for a suction tube (vacuum connector (18)) of a vacuum cleaner (1), where the opening (19) can be closed off with a separate closure piece (V) which can be moved from an open position to a closure position, being slid between two tiers (38, 40). For greater ease of handling the invention proposes that the closure piece (V) be practically fully enclosed in an outer contour of the retainer plate (16) in the open position and in the closure position and that the closure piece (V) lie exposed in a recess (57) of the uppermost tier (38) separate from the opening (19), the longitudinal extension of the recess (57) conforming to the closure piece (V).

28 Claims, 23 Drawing Sheets

T
22
21
23
18
18'
36
29
35
34
30
27
32
33
31
24
28
26
25
B
15 14
2
M
39 50 56 42 61 17 38 62 63 17 55 42 16 57
13
17
12
41 47 46 19 59 58 8 60 40 52 37 26' 6
V 212
219
209
210
212
209
210
209
210
209
210
209
210
209
210
213
205
217

DUST FILTER BAG FOR A VACUUM CLEANER

BACKGROUND OF THE INVENTION

The invention relates to a dust filter bag for a vacuum cleaner, having a mounting plate comprising a card-paper material, to which mounting plate a dust bag is connected, for example by gluing, which mounting plate has a sealingly closable opening for a suction tube of a vacuum cleaner, the opening being closable by a separate closure member which is displaceable from an open disposition into a closed position, the closure member being displaceable between two layers.

A dust filter bag of this kind is known from German Published Patent Specification 2 407 478. In this there is shown a dust filter bag, the opening of which for a suction tube of a vacuum cleaner is closable by means of a foldable paper strip. This foldable paper strip is located between two layers consisting of card in such a manner that one end of the paper strip is secured to the lower fixed layer in the region of a fold, for example by gluing. The other free end of the paper strip projects out beyond the contour of the layers, to form a grasping region. The two layers have circular openings for the suction tube of the vacuum cleaner. The paper strip also has a circular opening, which in the open disposition of the dust filter bag is aligned axially with the openings of the fixed layers In order to close the opening of the dust filter bag, the free end of the paper strip is pulled outwardly, whereby the folded strip is partially separated. The opening in the paper strip thus moves away from the region of the openings in the two fixed layers, whereby the opening of the dust filter bag is closed. There exists in this case no possibility, because of the construction, of reopening a dust filter bag which has already been closed, by reversing the displacement of the paper strip. In order to reuse a dust filter bag of this kind after an unintentional closure of the opening, there exists in this case only the possibility of destroying the paper strip in the region of the openings in the two fixed layers.

In addition, a dust filter bag provided with a mounting plate having a sealingly closable opening in known from U.S. Pat. No. 2,864,462. In this case also a closure strip is located between two fixed layers, the dust bag being secured to the lower fixed layer. The closure strip extends longitudinally over the entire length of the two layers. In the open disposition of the opening for the suction tube of a vacuum cleaner, a further opening in the closure strip is associated with the openings of the two fixed layers in the axial direction. For closing the opening for the suction tube, a peripherally open recess is provided in the upper layer, through which the closure strip may be gripped. If the opening of the dust filter bag for the suction tube is to be closed, the closure strip is gripped in the region of the strip projecting into the recess of the uppermost layer and is then drawn out of the region between the two fixed layers to a sufficient extent for the opening of the closure strip to leave the region of the two fixed layers.

In the two abovementioned known solutions, the closure strip extends out over the contour of the respective mounting plate in the closed disposition of the filter bag.

It is an object of the present invention to provide a dust filter bag for a vacuum cleaner of the kind in question which will be technically more advantageous from the point of view of handling.

SUMMARY OF THE INVENTION

By the construction, of the invention a dust filter bag for a vacuum cleaner is provided, the opening of which, in a mounting plate region for a suction tube of a vacuum cleaner may be both closed and also opened by means of a closure member, the closure member not extending over the outer edges of the mounting plate in either of the two end positions and also not extending over these outer edges in any intermediate position. This is achieved by the closure member being substantially fully accommodated within an outer contour of the mounting plate in the closed position and in the open disposition and by the closure member being exposed within a recess of the uppermost layer, which recess is separate from the opening, and a longitudinal dimension of the recess corresponding to a path of displacement of the closure member. It is also preferred that in the case of there being at least three fixedly disposed card-paper material layers in the mounting plate, one layer provides a support for the closure member in the open disposition. The closure member is formed to be of dimensions such that it is accommodated completely within the outer contour of the mounting plate both in the closed position and also in the open disposition. This is for example achieved by the closure member having a closure surface adapted to the opening in the mounting plate with a handle provided on it, which closure surface is moved into the opening region of the closure plate to bring about the closed disposition. The least possible path of displacement corresponds in this way to the diameter of the opening in the mounting plate.

In order to reopen a dust filter bag which has been closed by mistake, the closure member is moved in such a way that the closure surface leaves the region of the opening in the mounting plate at least to an extent sufficient for the suction tube of the vacuum cleaner to be introduced. The size of the closure member is for this purpose chosen so that the displacement movements are effected within the outer contour of the mounting plate. Reliable guidance of the closure member is guaranteed for this purpose in the case of there being at least three fixedly disposed card-paper material layers in the mounting plate, by one layer providing a substantially full surface area support for the closure member. In a favoured embodiment, the arrangement is such that the full surface area support for the closure member is provided both in the open disposition and also in the closed disposition. Deviating from the full surface area support, a contoured support may also be provided which may be recommended from the point of view of reduction of friction.

In order to achieve improved handling of the closure member, the closure member is exposed within a recess in the uppermost layer, which recess is separate from the opening, a longitudinal dimension of the recess corresponding to a path of displacement for the closure member. The exposed region of the closure member in the separate recess of the uppermost layer serves for this purpose as a handle. This region may be both gripped by hand as well as being mechanically engageable in the course of opening or closing the vacuum cleaner. Preferably, the construction of the mounting plate comprising the closure member may be so selected that the plate comprises three fixed layers, the centre layer having a recess for accommodation of the closure member. The width of the recess corresponds for this to the width of the closure member. The length of the recess by contrast derives from the length of the closure member plus the path of displacement, which corresponds at least to the diameter of the opening to be closed. The central layer accommodating the closure member may thus be formed as a frame closing all four sides. The lowermost layer forms in this connection a full surface area support for the closure member.

In order to sealingly close the opening of the mounting plate on entry of the suction tube, in a preferred embodiment, a further layer is provided, located underneath the lowermost layer, between which two layers a seal is inserted in the region of the opening. There is therefore provided a closable dust filter bag for a vacuum cleaner, which bag is optimised from the handling point of view. The closure member is fully accommodated within the outer contour of the mounting plate in the closed position and in the open disposition. Neither in the two end positions nor in any intermediate position, do any portions or regions of the closure member project outwardly beyond the outer contour of the mounting plate. Different vacuum cleaners afford, in the receiving region for the mounting plate of the dust filter bag, no free space for entry of any portion of the closure member projecting out beyond the outer contour of the mounting plate. The dust filter bag according to the invention may however be inserted into any vacuum cleaner of this kind and here be mechanically opened or closed in the course of opening or closing the vacuum cleaner. There exists however also the possibility of manual control of the closure element by hand.

In an advantageous further embodiment, it is provided that at least on a part of the path of displacement of the closure member, an edge of the closure member extends out to the edge contour of the mounting plate or beyond it. This construction can for example be provided in the region of edge recesses in the mounting plate for gripping the plate for removing the dust filter bag from the vacuum cleaner. In the region of these edge recesses, the closure member edges may extend to the edge of the recess, whereby at least over a portion of the path of displacement, the closure member may also here be moved for example by means of a clamping grip. There exists here also the possibility of the closure member edges extending out over the edge contour in the edge recess region. In a first version, the closure member edges extend only to a very small extent, of the order of tenths of a millimetre, out beyond the recess edge. In a second version, the extent may however be substantial, for example some millimetres or even in the centimeter range. In particular then, when a separate displacement projection is substantially provided laterally on the closure member, this also represents a possible alternative. Because of this construction, a further possibility for displacement of the closure member is provided, if for example a mechanical defect is present. As already mentioned, the closure member is mounted between two fixed layers, whereby lateral guidance is achieved by flanges or the like disposed between the two fixed layers. In this flange region, further abutments may be provided, which define both the open disposition and also the closed position of the displaceable member. Advantageously, the closure member is of substantially wasp-waisted shape in plan view. The spade handle forms in this connection the actuation section for the closure member. Here the lateral support for the closure member is realised by a further layer between two fixed layers, this single layer providing only one edge, which is formed as a negative or matching shape for the spade-shaped closure member having regard to the path of movement. In the region of the transition from the spade handle to the closure surface of the closure member, abutment edges are formed because of the spade shape in plan view, which in the open disposition abut against corresponding stop edges of the frame-shaped layer providing the lateral support. In the closed position, the peripheral edges of the closure member opposite the spade handle engage against a corresponding region of the layer providing the edge.

In order to assure optimal handling, it is provided that the spade handle is associated with the recess. As already mentioned, the longitudinal extent of the recess corresponds to the path of displacement of the closure member. Advantageously in this connection, the recess has a width which is at least as wide as that of the spade handle of the closure member. Alternatively, it is also possible for the spade handle to have a greater width than the recess. On one or both sides, the spade handle moves in this construction in underlying engagement with the edges of the recess. In this recess region, the spade handle providing the actuation section may now be gripped by hand or it may be mechanically displaced. In this regard, it may be provided that a handling projection is formed on the spade handle. This may be a thickened portion provided at the free end of the spade handle or it may be a recess provided in this region. In a preferred embodiment, the handling projection is so selected that the spade handle has a section which may be folded out. This section may be gripped by hand in a very simple manner. It is also possible to have a mechanical action in the region of the foldable-out section. Preferred in this connection is a construction in which two fold locations are provided.

The invention further relates to a vacuum cleaner having a dust filter bag, the dust filter bag having a mounting plate with an opening for a suction nozzle, and the mounting plate having a closure member which is automatically displaceable into a closed position in the course of opening the vacuum cleaner.

A construction of this kind is also known from U.S. Pat. No. 2,864,462 already mentioned. In this, the closable dust filter bag already mentioned is inserted into the vacuum cleaner in such a way that an actuation projection of the vacuum cleaner may engage in a recess at the free end of the closure member. By means of this actuation projection, the closure member of the mounting plate is automatically moved into a closed position in the course of opening the vacuum cleaner. In this connection, it is also known for the closure member to be actuated by the actuation projection during closing of the vacuum cleaner in such a way as to enable the opening in the mounting plate for a dust filter bag to be exposed.

In an advantageous embodiment of the invention it is provided that the actuation projection is arranged to be spring biased in the direction of its extension. Because of this embodiment, the actuation projection is also usable in vacuum cleaners of the kind which have a tight radius between the axis of pivoting of the vacuum cleaner portion carrying the dust filter bag and the closure member of the other vacuum cleaner portion. In the case of such narrow radii, it is especially necessary for the actuation projection to yield in dependence on the pivoting movement after engagement in the closure element or abutment against this. Of particular importance also is the pliability or resilience of the actuation projection for preventing self-jamming or self-blocking. Also, if the actuation projection should at any time engage the dust filter bag at an unfavourable angle, further pivoting of the actuation projection-carrier may be achieved by the compression (in the particular case of the drag cover, see below), and thus the angle of attack between actuation projection and dust filter bag may be changed, so that self-jamming is no longer in question.

The moveability and resilience is in particular so effected that the actuation projection may be correspondingly shortened in its direction of extension in the course of pivoting of the dust filter bag into the disposition of use of the vacuum cleaner. This spring biased construction of the actuation projection is also then especially of advantage when dust filter bags are used which are not correspondingly adapted, in particular then, when dust filter bags are used which have no device for closing the opening for the suction connection.

In an advantageous further embodiment it is provided that the actuation projection is formed on a drag cover. A drag cover of this kind is in particular of advantage for vacuum cleaners having dust filter bags in which the dust bags are in an inverted disposition. In this case, for withdrawal of the dust filter bag, the bag chamber is pivoted together with the drag cover. Subsequently, there then takes place the actual opening of the bag chamber, for which the drag cover is pivoted in such a way that the dust filter bag is exposed. In this connection, the actuation projection provided on the drag cover moves the closure member for the mounting plate of the dust filter bag in such a manner that the opening in the mounting plate for the suction connection is closed. If further use of this dust filter bag is however subsequently required, the drag cover may be pivoted once again in the direction of the bag mounting, whereby the actuation projection once again displaces the closure member in such a way that the opening in the mounting plate is exposed.

It is however in this connection fully feasible for the actuation projection to be provided directly on the vacuum cleaner, i.e. without requiring a drag cover. An optimisation from the point of view of use is in addition achieved by the actuation projection being pivotable against a spring. The second spring (in contrast to the first spring, against which length of the actuation projection may be reduced) effects substantially a closing force for a displacement of the closure member into the closed position. In particular for an opening operation of the vacuum cleaner, the second spring, in the further course of the opening movement, pushes the actuation projection still farther forward and thus effects at least the last portion of the closing movement of the closure member. In addition to the spring biased construction of the actuation projection in the direction of extension, this is therefore also formed to be pivotable against a spring.

Furthermore it is provided that connected with the actuation projection, registration projections may be provided, which on completion of pivoting of the actuation projection, enter into registration openings of the other vacuum cleaner portion, whereby closure of the vacuum cleaner is only possible on entry of the registration projections. By this it is assured that closing of the vacuum cleaner is only possible when a dust filter bag has been inserted. If no dust filter bag has been inserted, the actuation projection finds no corresponding support on closing the vacuum cleaner, so that the actuation projection may not be displaced out of its position, the registration projections connected with it also remaining in their blocking disposition. If it is now sought to close the vacuum cleaner, the registration projections engage against corresponding blocking regions of the other vacuum cleaner portion. When a dust filter bag is however inserted, the actuation projection pivots in the course of closing the vacuum cleaner, whereby the registration projections are also displaced in such a manner that they may enter into the registration openings of the other vacuum cleaner portion and thus allow the closing of the vacuum cleaner. In advantageous manner, it is provided in this connection that the registration projections are formed on a plate fixedly connected to the actuation projection.

On use of a filter bag in the above described manner, the actuation projection of the vacuum cleaner engages the closure element in the region of its spade handle formed as an actuation section. If the spade handle of the closure member is provided with a foldable-out section, the actuation projection engages behind this foldable-out section on opening the vacuum cleaner and thus moves the closure member into a closing position for the opening in the mounting plate of the dust filter bag. If a closed dust filter bag of this kind requires to be reused, the actuation projection of the vacuum cleaner engages the region of the foldable-out section in such a manner, in the course of closing the vacuum cleaner, that the closure member is moved into an open disposition.

It is obvious that in the case of use of a dust filter bag opened in conventional manner, there is no interference with the function of the actuation projection. It is thus unimportant whether the dust filter bag is inserted into the vacuum cleaner in an open condition or a closed condition. On displacement of the closure member into the open disposition, in one embodiment of the invention, the actuation projection may overrun a handling projection on the closure member, preferably the spade handle of the closure member. Also after overrunning this closure projection, the longitudinal reserve for the partially compressed actuation projection has not quite run out. Rather is it desired for the actuation projection to abut against a stop fixed to the housing after overrunning the handling projection, at a specific degree of shortening in length (compression). This is also of importance insofar as, during an opening operation, the suction connection of the vacuum cleaner may initially move out of the opening of the filter bag before the actuation projection is pivoted with it in the course of the further opening or pivoting action, since in the meantime, the longitudinal reserve is fully used up by extension of the telescopic length of the actuation projection. Only then is the opening of the dust filter bag pushed closed, since now the opening is also exposed, as the suction connection has moved out of it.

In addition, the results, on closing the vacuum cleaner, a marked clicking noise, by the overrunning mentioned of the handling projection by the actuation projection and the movement limitation of the actuation projection by abutment against the projection fixed to the housing, which also signals to the user that the vacuum cleaner is now fully in order for use.

The invention further relates to a vacuum cleaner of the kind initially mentioned, in which there is provided a peripheral rubber seal projecting inwardly over the edge of the opening. A dust filter bag of this kind is known for example from German Patent Specification 1 39 19 256. Reference is also made from the point of view of the state of the art to German Patent Specification 1 24 07 478. For the dust filter bag known from German Patent Specification 1 39 19 256, an opening is also provided in a displaceable closure portion, whereby for use of the dust filter bag, the opening in the mounting plate and the opening in the displaceable closure portion must be brought into a disposition one over the other. The opening in the displaceable closure portion has an annular seal. In the case of such a seal, it may come to pass in the course of use that the seal becomes raised to a certain degree and that closure of the dust filter bag in the required manner is then no longer possible The problem resulting from this, to provide a dust filter bag of this kind in which a full closure is guaranteed, is initially and substantially solved by the subject matter of the invention in to project inwardly from the periphery of the opening to overlap the rubber seal.

For a rubber seal, as it is here defined, the material rubber is not in question, but this seal may consist of any other kind of elastomer or comparable material, and may during use of such a dust filter bag experience a certain impressed deformation because of introduction of the suction tube. In particular, a loss of the elastic properties is often to be observed. This is particularly the case when, as often occurs, the inserted suction tube of the dust filter bag remains in this position for several weeks or months. On withdrawal of the suction tube, there may then be in question a turning up of the rubber seal projecting into the interior of the dust filter bag. This then blocks a complete closing movement of the opening. The stabilising portion provided according to the invention now ensures that this turning up does not arise and that the rubber seal is given a pre-impress in the direction of the interior of the dust filter bag (downwardly).

The stabilising portion may in particular also comprise the card-paper material previously discussed. There thus comes about also a folding of the stabilising portion on insertion of the suction tube. Because however the stabilising portion is not able to fold back when the suction tube is withdrawn from the opening, on account of its surface stability, the rubber seal remains directed into the interior of the dust filter bag even after complete removal of the suction tube from the opening. Suitably the stabilising portion is mounted at the location on the opening which location is the last to be occluded by the closure member during a closing operation Moreover there may naturally also be provided several stabilising portions of this kind or even a stabilising annular edge, the entirety of which is folded over substantially on insertion of the suction tube. It is also advantageous for a dimension of the stabilising portion in an inward direction with respect to the peripheral edge of the opening to correspond approximately to one-half of the dimension of the rubber seal in the inward direction, in the same direction therefore. Because of this the rubber seal is formed with a substantially greater width than has previously been visualised. The stabilising portion has rather suitably a dimension which corresponds to the previously customary width or dimension of the rubber seal in the inward direction. Relative to a diameter of the opening in the mounting plate for the dust filter bag, the dimension of the stabilising portion in the inward direction is for example one-tenth. The conventionally annularly-shaped rubber seal extends in the inward direction substantially over an extent of two-tenths of the diameter of the opening.

A mounting plate for a dust filter bag, as here discussed, has for example a multilayered construction. It is assembled from several layers of card-paper material. In this regard, the stabilising portion is preferably provided on a layer of the mounting plate which is in direct contact with the rubber seal. It is also recommended for the stabilising portion to be provided on the side of the rubber seal directed away from the dust bag. In particular, the stabilising portion may also be provided in the form of a tongue.

A further subject of the invention is a vacuum cleaner of the present kind, in particular having a receiving portion for a dust bag, a drag cover or a closure flap having an actuation projection being provided on the receiving portion, for actuation of a pusher as closure member on a dust filter bag, the actuation projection being formed to be resiliently biassed in its direction of extension and being pivotable as a whole against a spring. The pivotability is relative to the closure plate. In particular, reference is here made to European Patent Specification 1 25 32 057, in so far as there is in question the basic construction of the vacuum cleaner with the receiving portion for the dust filter bag and the mounting plate, which is displaceably secured to the receiving portions.

The actuation projection is now provided on the underside on this receiving portion, the actuation projection serving for actuation of a pusher or closure pusher provided in the filter bag. In regard to such a filter bag there exists the technical problem of achieving actuation of the pusher, which operates on the dust filter bag, in the most reliable possible manner and with certainty, with at the same time the least possible closing force or general negative impact on the dust filter bag and in particular on the mounting plate. In this regard, the invention proposes that the actuation projection is connected to the closure plate in such a manner that in the course of compression of the actuation projection, a simultaneous pivoting is introduced. The connection of the operating projection to the closure plate functions so that on compression, by which initially a linear displacement of the actuation pusher takes place, the spacing between the points of connection is increased If a strap or the like is now used for the connection, this is stretched and reaches a condition in which it can no longer undergo any substantial increase in length. On the application of further pressure to the closure plate, the actuation projection is therefore pulled against the closure plate so that there arises the pivoting of the actuation projection onto the closure plate, hitherto achieved in the course of the further actuation, but now even sooner. There is achieved by this at the same time a limitation in the force, since with increasing compression of the actuation projection in the linear direction, the force exerted by the tip of the actuation projection on the mounting plate of the dust filter bag also increases. By means of the connection, which is limited in lengths there is achieved an earlier cessation of this compression movement under increased application of force to the mounting plate than in the case of a movement operation without the connection. In a further embodiment it is envisaged that the connection consists of a flexible connecting means. The connecting means may be a strap or a cord.

In a further solution of the problem posed, it is also provided that the actuation projection has lateral support elements for support on a frame of the receiving portion. The lateral support elements may be provided directly on the actuation projection, in particular, when this, as preferred, is formed by a plastics moulded portion. The receiving portion also preferably further provides a slideway for the lateral supports. When in the course of the movement of the closure plate after an initially completed compression of the actuation projection in its axial direction, the pivoting of the actuation projection towards the closure plate takes place, the lateral supports slide on the slideway mentioned. It is important that by virtue of these supports, a force loading, which initially introduces a movement of the closure plate of the receiving portion into the closed position on the mounting plate of the dust filter bag, is limited to a specific value or range. Furthermore, the force diverted by way of the supports, is taken up by the receiving portion of the dust bag.

The subject of the invention is described below in more detail having regard to embodiments shown in the drawings.

BRIEF DESCRIPTION OF THE DRAWINGS

FIG. 7 shows the features of FIG. 5 in a view from below, FIG. 25 shows the arrangement according to FIG. 21, but with the actuation projection pushed in.

DETAILED DESCRIPTION OF THE PREFERRED EMBODIMENTS

Figure 1:
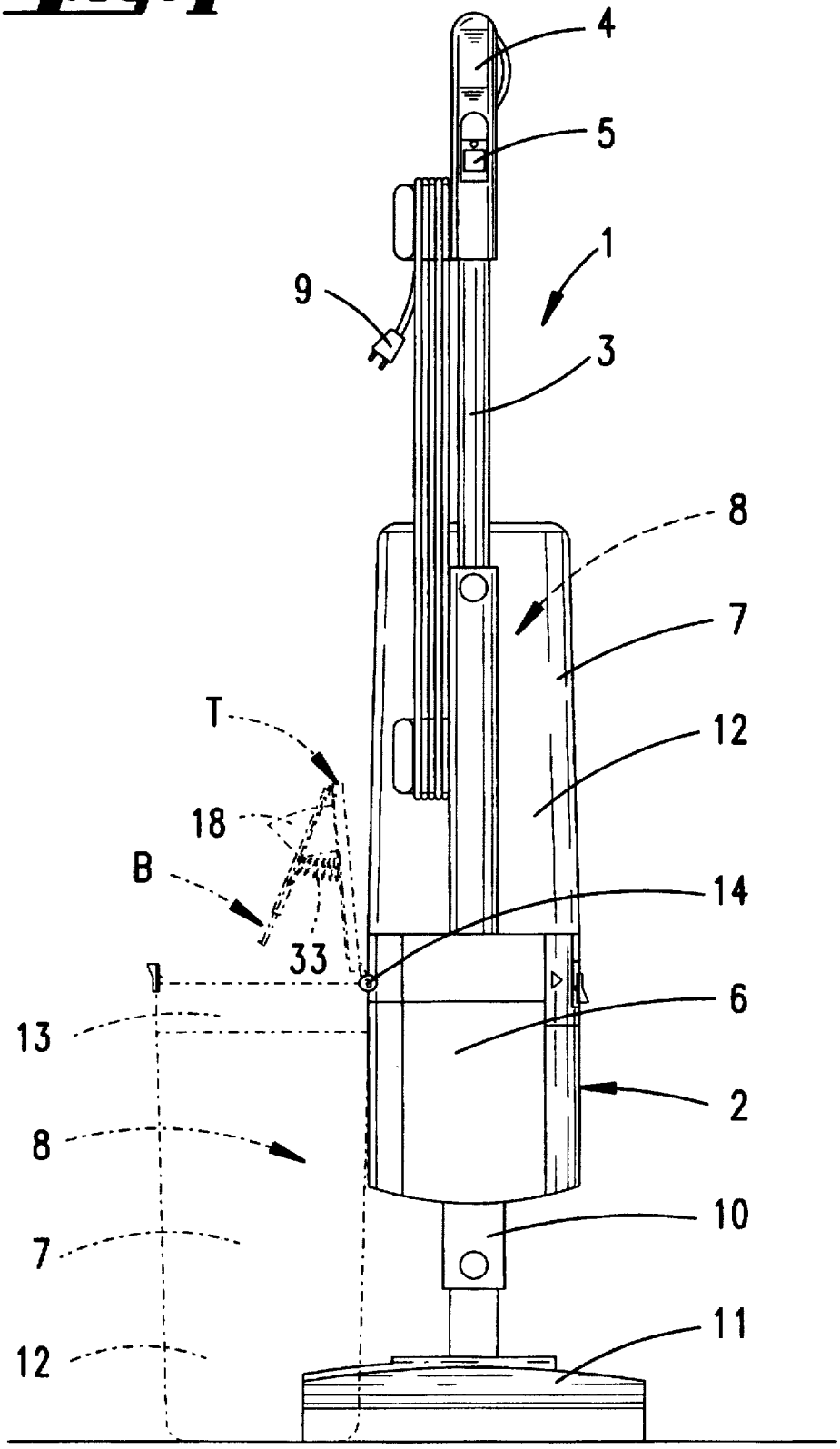
FIG. 1 is a view onto a vacuum cleaner according to the invention with the opened-out position of the chamber containing the filter bag indicated in chain-dotted manner.
Figure 2:
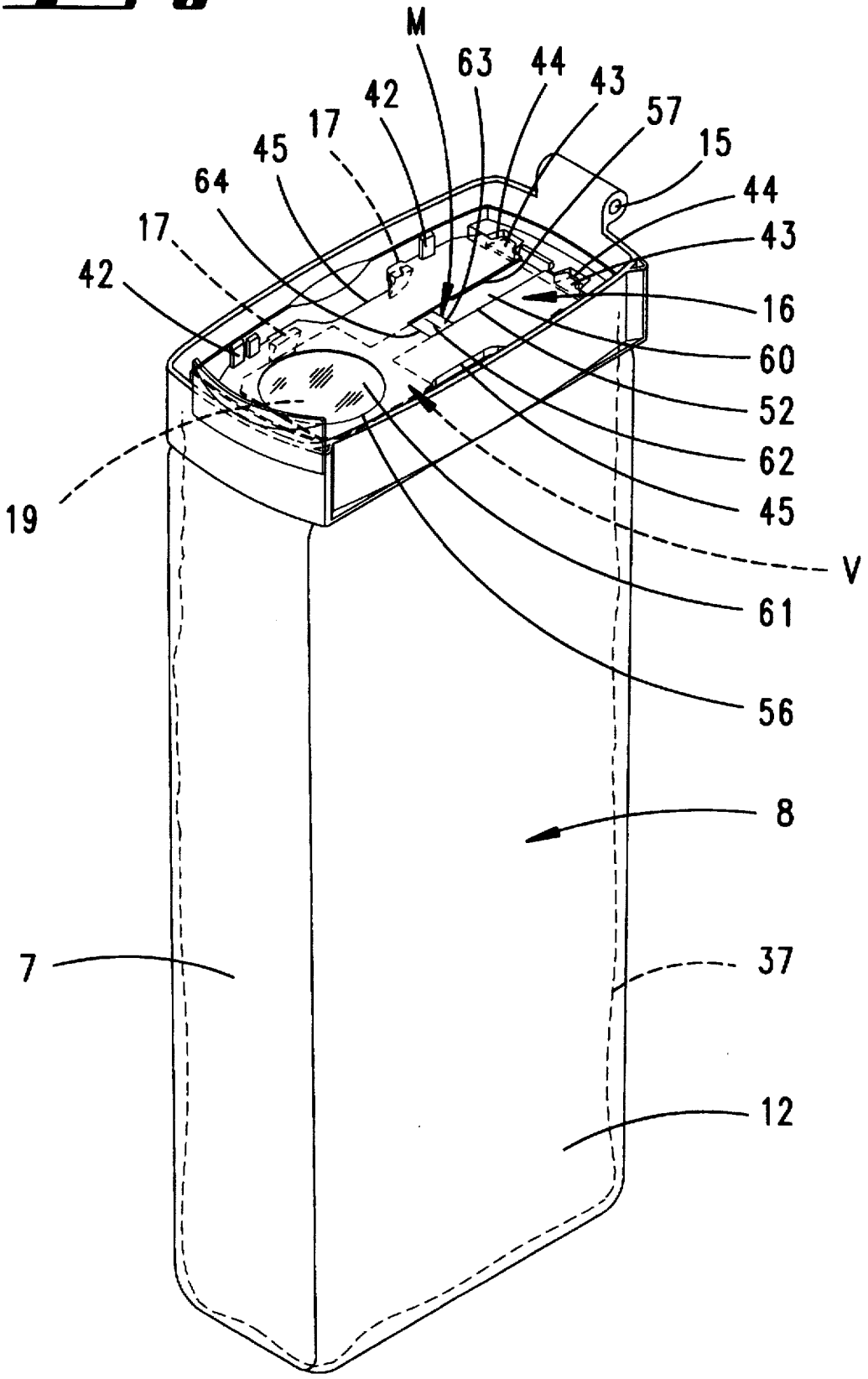
FIG. 2 shows the chamber containing the filter bag in perspective individual representations an opening in a mounting plate region of the filter bag for entry of-a suction tube of the vacuum cleaner being closed-off.

The electrical vacuum cleaner 1 shown is formed as a hand appliance. It has a housing 2, at the upper end of which there is connected a handle 3, the handle 3 having a grip 4 at its end. In the transition region between grip 4 and handle 3, there is an on and off switch 5. The electric cable connection is designated by the reference numeral 9.

The housing 2 is divided into a motor housing 6 and a chamber 7 extending above the motor housing for the reception of a dust filter bag 8. The motor fan is not shown in detail in the drawings.

The side of the dust filter bag 8 directed towards the motor housing 6 stands, in the operating disposition of the vacuum cleaner according to FIG. 1, in a nozzle connectional relationship with a blower air channel of the motor fan.

On the underside of the motor housing 6, the housing has a transition into a tubular coupling 10, which provides the airflow connection to a suction nozzle 11.

In regard to the suction nozzle 11, there may be in question a so-called suction/brush nozzle, which has a brush roller in the nozzle mouth, the brush roller being set in rotation by way of a separate drive.

The fan motor functions therefore from below in an upward direction, forcing as a result the dust-laden air into the dust filter bag 8 located in an inverted disposition above the motor housing 6.

The cross-section of the housing 2 is longitudinally rectangular over its entire height with long sides gently curved in an outward direction and similarly formed short sides. In FIG. 1, the vacuum cleaner is to be seen from the long side.

The chamber 7 receiving the dust filter bag 8 of corresponding cross-section is defined by a textile bag 12 stiffened by means of wiremesh, the lower end of which bag, that is, the end of the bag at the motor housing, has a transition into a stiffened edge in the form of a filter frame 13. The stiffened textile bag 12 may be associated with this filter frame 13 by way of the releasable clip insertion connection. The attachment region is offset for this.

For withdrawal of the dust filter bag, the housing 2 is opened out for substantially full exposure of its cross-section. The folded out position may be seen from FIGS. 1 (in this case shown in chain-dotted manner), 3, 4, and 11 to 13. The pivot axis 14 enabling this is located on one of the short or narrow sides of the housing 2. The bearing eyes on the filter frame for this pivot axis are designated by the reference numeral 15. These bearing eyes 15 are located at the transition region between a short side and a long side of the chamber 7. Between the two bearing eyes 15, there extends a continuous bearing eye of the motor housing 6.

In the separating joint region between motor housing 6 and chamber 7, there is comprised in addition a drag cover T in the form of an intermediate support, on which the dust filter bag 8 is seated. An intermediate support or carrier T of this kind is known from German Published Patent Application 39 11 580 of the present Applicant. Reference is made to this document in the present connection, as to the full content of the document.

The drag cover T has a shape in plan view adapted to the cross-section of the housing, set back however from the sleeve wall of the housing 2, so that in the coaxial disposition of motor housing 6 and chamber 7 shown in FIG. 1, the drag cover T is substantially completely out of sight. The drag cover T is also formed to be pivotable, the drag cover T having two bearing eyes on the hinge side, as is also the case for the filter frame 13 In this way, the drag cover T pivots about the same pivot axis 14 as the chamber 7.

The dust filter bag 8 connected directly to the drag cover T has a base formed as a mounting plate 16. The general shape in plan view of this mounting plate also corresponds to the cross-sectional shape of the filter frame 13, which has peripheral steps 17 provided on the internal wall for supporting abutment of the mounting plate 16. In this way, the mounting plate 16 cannot fall into the chamber 7 in the pivoted disposition of the appliance. The common pivot axis 14 of filter frame 13 and drag cover T extends over substantially the height of the supporting peripheral step 17 of the filter bag mounting plate 16.

When the housing 2 is closed, that is, in the working configuration of the vacuum cleaner 1, the blower air channel of the motor fan penetrates into the lower region 18' of a suction connection 18 by means of an offset cylindrical mouth end. This suction connection 18 projects above the upper side of the drag cover T, the suction connection 18 being formed similar to the drag cover T and the suction connection 18 projecting into the interior of the dust filter bag 8 in an edge sealing manner, to penetrate through an opening 19 of the filter bag mounting plate 16, the opening 19 being of corresponding cross-section to that of the suction connection 18.

The suction connection 18 tapers towards its free end, so that the introduction of the connection 18 into the opening 19 has in effect a centering action.

Figure 3:
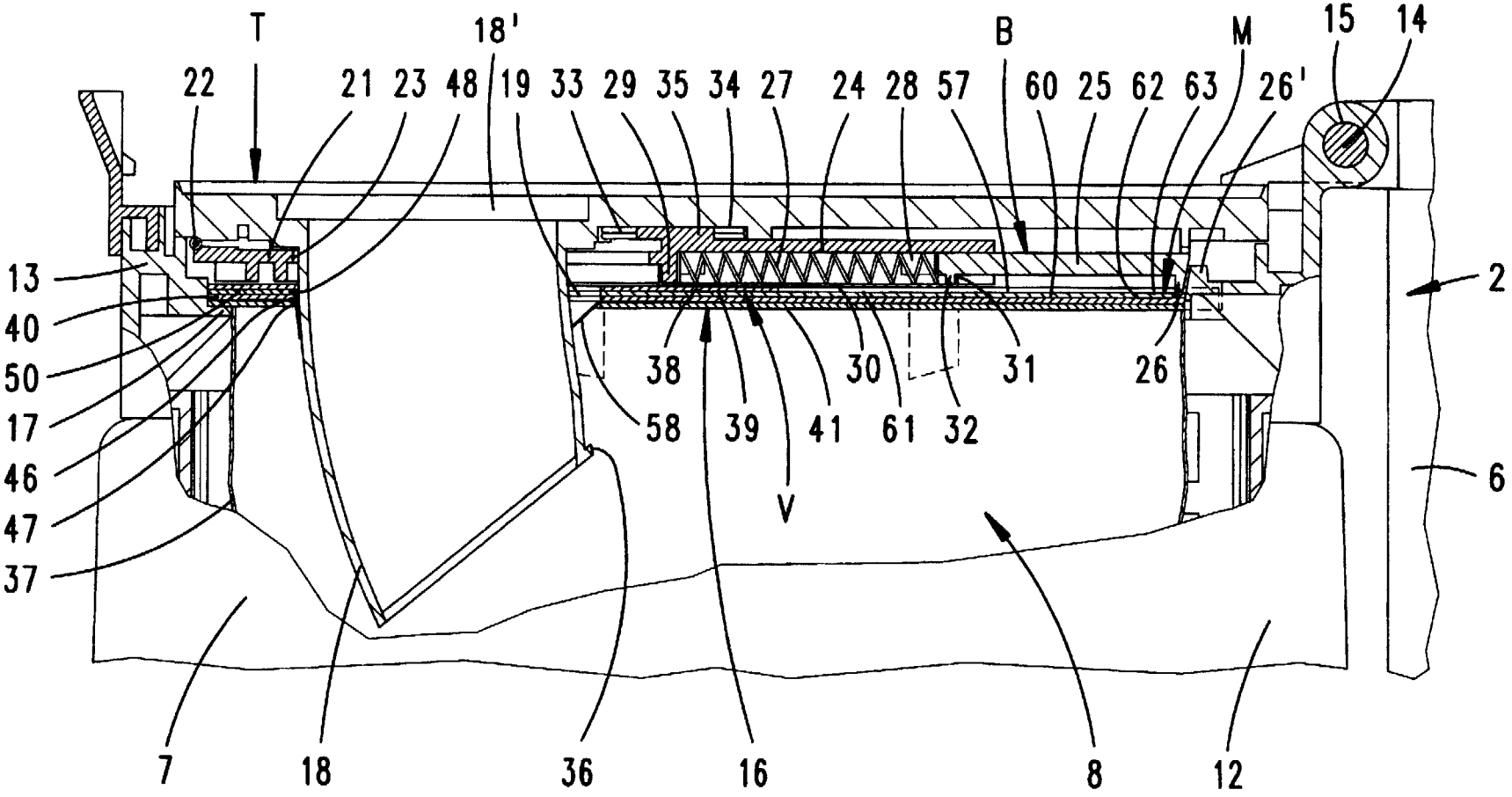
FIG. 3 shows the chamber region for reception of the filter bag in the open position of the chamber, partially in section.
Figure 4:
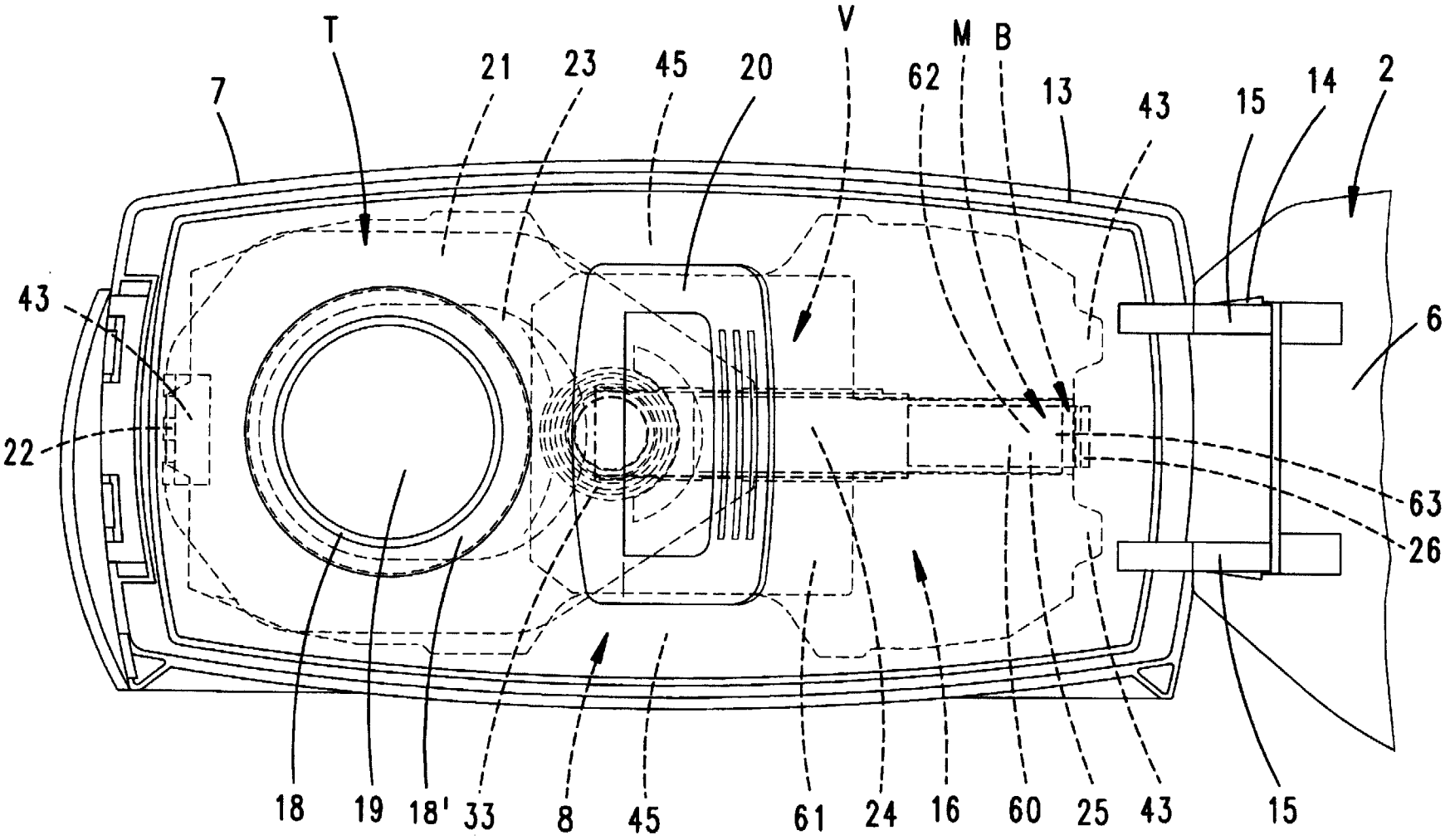
FIG. 4 is a plan view onto the region of FIG. 3.
Figure 5:
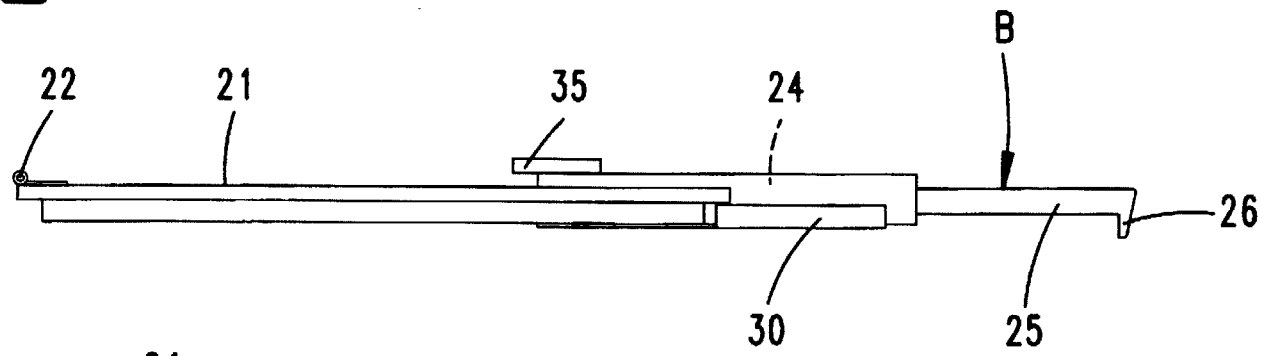
FIG. 5 shows an actuation projection of the vacuum cleaner in individual representation, the actuation projection being provided with a plate, and the arrangement being shown in side view.
Figure 6:
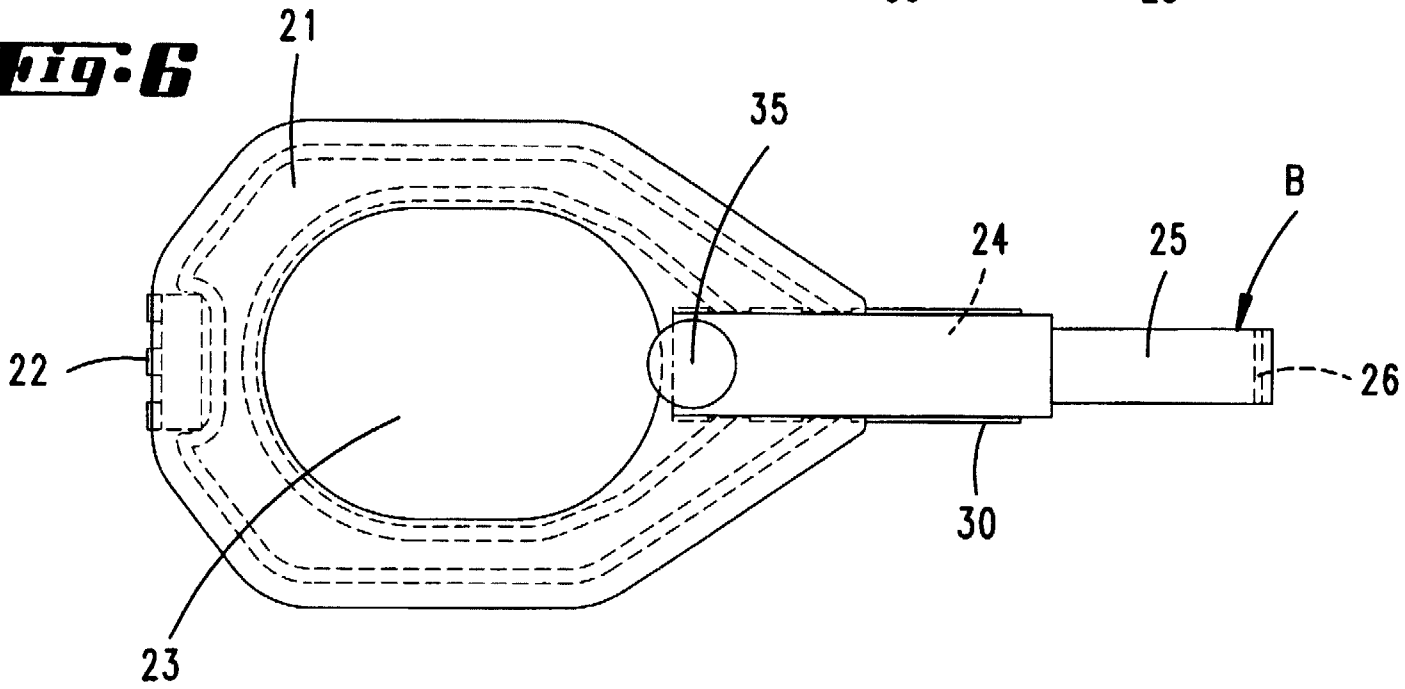
FIG. 6 shows the same features as FIG. 5, but in plan view.
Figure 4:
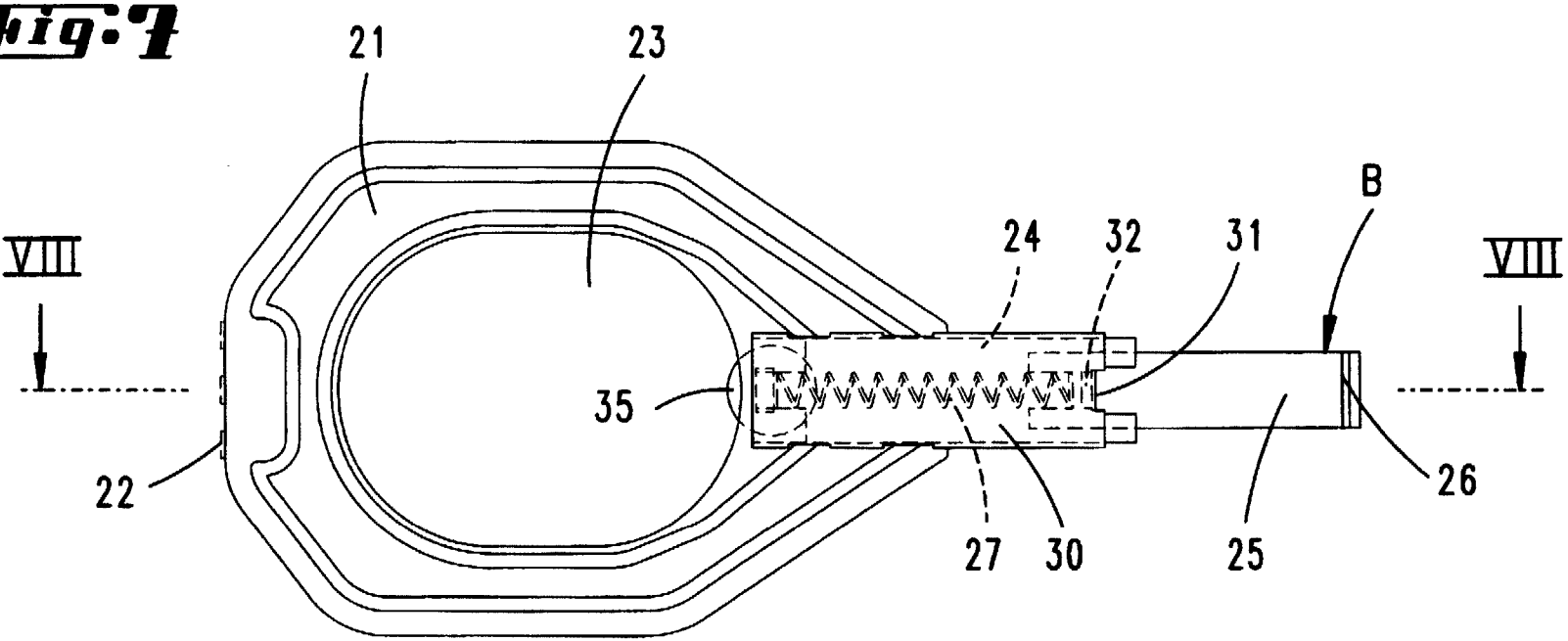
Figure 8:
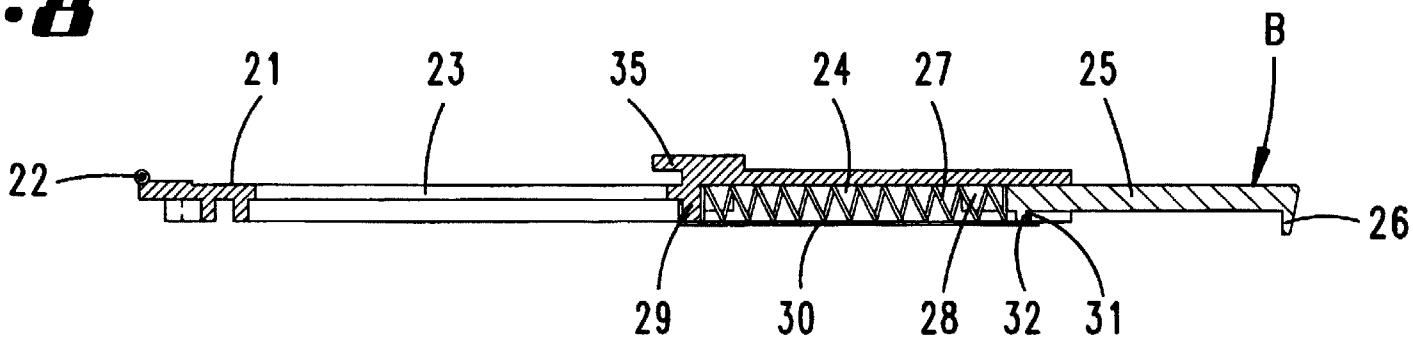
FIG. 8 is a section on the line VII—VII of FIG. 7.

For withdrawal of the dust filter bag 8, the chamber 7 with the drag cover T is swung into the open position shown in FIG. 3, after release of a closing catch on the housing. In order to now release the dust filter bag 8 for withdrawal, the drag cover T is pivoted away from the chamber 7, for which a handgrip 20 is provided on the upper side of the drag cover T which is directed away from the suction connection 18. This handgrip 20 is pivotably disposed on the upper face of the drag cover T by means of a film hinge.

In order to prevent the falling back of dust and dirt into the motor housing region 6, in the operating disposition of the vacuum cleaner according to FIG. 1, because of the inverted position of the dust filter bag 8, a flap valve may be provided at the free end of the suction connection 18.

On the underside of the drag cover T, i.e. on the side of the cover T directed towards the suction connection 18, there is associated with this cover T a pivotable plate 21 for holding an actuation projection B. This plate 21 is pivotably disposed at the free end of the drag cover T by means of a hinge 22. The plate 21 extends forwardly from the hinge 22 up to substantially the middle of the drag cover T, to surround the suction connection 18 For this latter, the plate 21 has an opening 23 of oblong form. The region of the plate 21 directed away from the hinge 22 is taperingly formed. In this regions a receiving chamber 24 of rectangular shape in cross-section is defined in a positive manner, which chamber projects out beyond the end region of the plate 21. In this receiving chamber 24, the actuation projection B is mounted to be freely displaceable, the actuation projection B being comprised substantially of an actuation arm 25 which is of rectangular shape in cross-section and an actuation nose 26 formed at the free end of this actuation arm 25, that is, at the end of the arm directed away from the receiving chamber 24. The actuation nose extends in the configuration shown in FIG. 3 towards the dust filter bag 8.

The actuation projection B is arranged to be spring-biassed in its longitudinal direction. For this, there serves a compression spring 27 accommodated in the receiving chamber 24, which spring surrounds a pin 28 provided at the end of the actuation arm 25 projecting into the receiving chamber 24. At the other end, the compression spring 27 abuts against an end wall 29 of the receiving chamber 24. This receiving chamber 24 is closed-off by a cover 30, which engages around the end wall 29 and the side walls of the receiving chamber 24. In the open end region, that is, in the region in which the actuation arm 25 projects into the receiving chamber 24, the cover 30 has an inwardly projecting supporting collar 31. This latter serves as an abutment stop for the actuation arm 25 which is biassed in the outward direction by the compression spring 27, the actuation arm having a matching corresponding abutment edge 32.

The plate 21 and the actuation projection B carried by this are pivotable about the hinge 22 against a spring 33. For this purpose, this spring 33 extends between the underside of the drag cover T and the side of the plate 21 directed towards this underside. To achieve this, a corresponding recess 34 for reception of one of the ends of the spring 33 is provided on the underside of the drag cover T. The other end of the spring 33 engages around a circular projection 35 of the plate 21 in the region of the transition from the plate 21 to the receiving chamber 24. The spring 33 biasses the plate 21 and the actuation projection B connected to this plate at all times towards the dust filter bag 8. The path of pivoting of the plate 21 is limited in such a manner that on pivoting the drag cover T away from the dust filter bag 8 and away from the holding plate 16 for this bag, the edge of the projection 35 of the plate 21, which projection extends into the aperture region 23, abuts against a collar 36 on the outer periphery of the suction connection 18 (see FIG. 12). The spring 33, as has already been further described in detail above, is in particular also of importance for the further execution and especially for the completion of the closing or sealing movement when opening the vacuum cleaner.

The dust filter bag 8 is comprised substantially of the mounting plate 16 already mentioned and of a dust bag 37, preferably formed from paper, on the underside of this mounting plate 16, for example adhesively connected to the plate.

The mounting plate 16 has a shape corresponding closely to the inner side of the filter frame 13 and comprises four layers of cardboard-paper material laid one over the other. These layers 38 to 41 are glued to one another. The mounting plate 16 thus formed is supported in the inserted condition of the dust filter bag 8 on the peripheral steps 17 of the filter frame 13. In order to prevent the dust filter bag 8 from being dislodged in the operating configuration of the vacuum cleaner 1 according to FIG. 1, retaining features 42 are provided, which are located on the inner side of the filter frame 13 and act on the upper side of the mounting plate 16. The dust filter bag 8 is thus held in its mounting plate region 16.

For locationally correct secure placement of the dust filter bag 8, the mounting plate 16 has orientation features 43 in its two short side regions, which engage in corresponding counter-features 44 of the inner wall of the filter frame 13. In regard to the orientation features, there are in question projections of trapezoidal shape on the short or narrow side of the plate-shaped body forming the mounting plate 16.

There is thus achieved a position which is correct as to alignment between opening 19 and suction connection 18.

On the peripheral edges of the longer sides, the mounting plate 16 has gripping openings 45. The two gripping openings 45 are bevelled and are open towards the corresponding inner wall of the filter frame 13. In the open disposition of the housing 2 and after the drag cover T has been swung back, the dust filter bag 8 may be comfortably grasped by gripping across the set back central zone of the mounting plate 16, which is of wasp-waist shape, and the bag may be lifted out of the chamber 7.

As already mentioned, the mounting plate 16 comprises four layers 38 to 41 laid one over the other, the paper dust bag 37 being glued onto the lowermost layer 41 on the underside. This lowermost layer 41 has a circular aperture 46. The layer 40 located above this layer 41 is formed to be the same as the layer 41 as to shape and surface area and also has an aperture 47 located coaxially with the aperture 46, which aperture 47 also has the same radius as the aperture 46.

Figure 10:
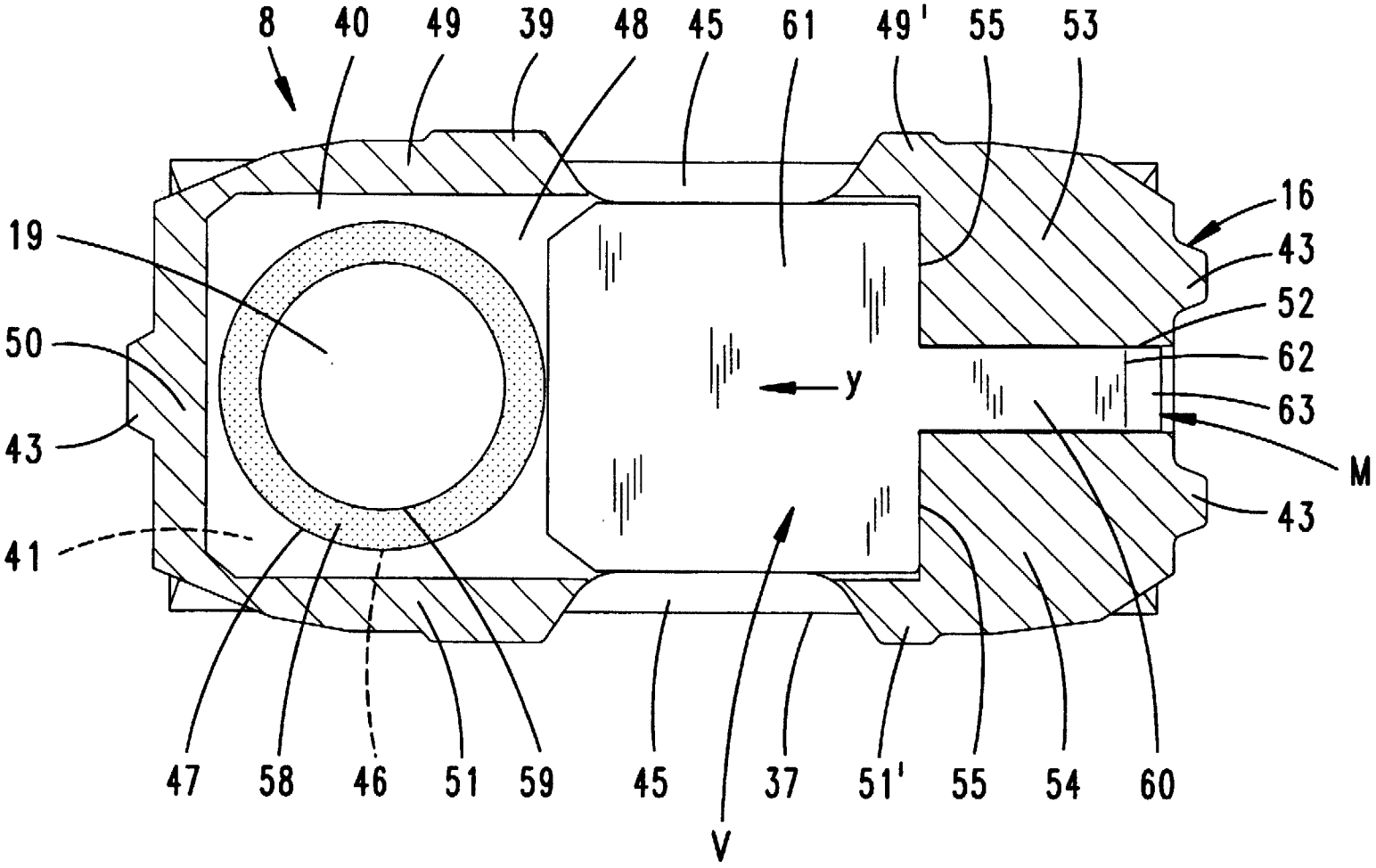
FIG. 10 is a plan view onto the dust filter bag with its mounting plate, an uppermost layer being omitted.

The layer 39 located over the layer 40 is formed as a spacing layer for the layer 38 providing the top and serves to define a free space 48. FIG. 10 shows a plan view of the layer 39 with omission of the layer 38 which lies over this layer 39 and forms the top. The layer 39 is in general formed as an edge strip having the same external shape as the other three layers. In practice, this is so effected that layer sections 49 to 51 are provided at the outer edge in the region of the aperture 47 of the layer 40, which layer sections extend from the respective outer edge to the vicinity of the aperture 47, leaving a spacing between the aperture 47 and the inner edge of the respective layer strip. The layer strips 49 and 51 provided on the long sides of the mounting plate 16 are connected to the layer strip 50 at the end edge directed towards the aperture 47 and extend outwardly from this layer strip 50 into the gripping opening regions 45, which gripping openings are formed by corresponding recesses in the layers 38, 40 and 41. The spacing between the two peripherally inner edges of the layer strips 49 and 51 is in this connection selected to be greater than the spacing between the peripheral edges of the gripping openings 45 directed towards one another On the opposite side of the gripping openings 45 from the layer strips 49 and 51, the layer strips continue as layer strip sections 49' and 51', with retention of the same width. While maintaining a spacing from the gripping openings 45, the layer strip sections 49' and 51' are widened in such a manner that proceeding from the outer periphery of the mounting plate 16, they extend into the central region of the mounting plate 16, while leaving a slit 52. This widened region of the layer 39, which as a result is located in the end region of the mounting plate 16 opposite to the aperture 47, are indicated by reference numerals 53 and 54. In the transition region between the layer strip sections 49' and 51' and the regions 53 and 54, there are therefore defined abutments 55 which are effective in the longitudinal direction of the mounting plate 16.

The uppermost layer 38 defining the top has a configuration which is the same as that of the layers 40 and 41 as to shape and almost the same as to area. In this case also, an aperture 56 is provided, coaxial with the apertures 46 and 47. These apertures 46, 47 and 56 define the opening 19, already mentioned, in the mounting plate 16. The uppermost layer 38 is further provided with a recess 57 located above the slit 52 of the layer 39, the recess 57 being open at the edge and having almost the same width as the slit 52. This recess 57 extends proceeding from the short or narrow side of the mounting plate 16 opposite the opening 19 in the direction of the longitudinal extent of the mounting plate 16 to substantially the middle of this latter.

Between the two lower layers 40 and 41, a rubber seal 58 is inserted and preferably glued in position. This rubber seal 58 is provided in the region of the apertures 46 and 47 and has a circular opening 59, which is formed to have a smaller diameter than the diameter of the apertures 46 and 47. The opening 59 of the rubber seal 58 is in this connection aligned coaxially with the apertures 46 and 47. The rubber seal 58 serves for the sealing connection between the dust filter bag 8 and the suction connection 18, when the suction connection 18 enters through the opening 59 and projects into the interior of the dust filter bag 8.

In the free space 48 defined between the layers 38 and 40 and bounded by the layer strips of the layer 39, a closure member V is displaceably mounted (see FIG. 10). The closure member V is for this substantially of spade shape in plan view, a spade handle 60 being located, in the disposition shown in FIG. 10, in the slit 52 of the layer 39. The closure plate 61 connected to the spade handle 60 has a width almost corresponding to the spacing between the peripheral inner sides of the layer strips 49 and 51 and the layer strip sections 49' and 51' and extends, in the disposition according to FIG. 10, proceeding from the abutments 55 of the layer 39, to the edge of the aperture 47 of the layer 40 and to the edge of the opening 19.

The spade handle 60 of the closure member V is in this regard exposed within the recess 57 provided in the uppermost layer 38 and serves as an actuation section. For this, the spade handle 60 has a handling projection M in the form of a fold location 62. By this, there results at the free end of the spade handle 60, a section 63 which may be folded out from the spade handle.

It is also possible for the handling projection M to be formed in such a manner that at the free end region of the spade handle 60, a thickened region is provided. Alternatively, for this purpose, there may also be provided in this region, a recess in the form of a longitudinal slit or the like.

Because of this formation of the mounting plate 16, it is now possible to selectively close or open the aperture 19 by means of the closure member V. For this, the closure member V is displaced longitudinally in the free space region 48 of the layer 39, the closure member V being fully accommodated within the external contour of the mounting plate 16 both in the closed position and also in the open position, as well as at every intermediate position. This means that portions of the closure member V do not project outside the external shape or contour of the mounting plate 16, either in the closed disposition or in the open disposition. This is also not possible in the case of the embodiment shown, since the shape and size of the filter frame 13 of the vacuum cleaner 1 would not allow any enlargement of the external shape or contour of the mounting plate 16.

The displacement of the closure member V takes place by grasping or gripping at the handling projection M, which is exposed for engagement in the recess region 57 of the uppermost layer 38. For this purpose, this recess 57 corresponds in its longitudinal extent to the path of displacement of the closure member V. By displacing the closure member V from the open disposition according to FIG. 10 into a closed disposition in the direction of the arrow y, the opening 19 in the mounting plate 16 is closed by means of the closure plate 61. For this, the closure member V is guided at its sides by the layer strips 49 and 51. The end position for the closed configuration is achieved when the end edge of the closure plate 61 abuts against the inner peripheral edge of the end edge of the layer strip 50.

The open disposition is defined by the abutment, already mentioned, of the closure plate 61 against the stops 55 of the layer 39.

Figure 11:
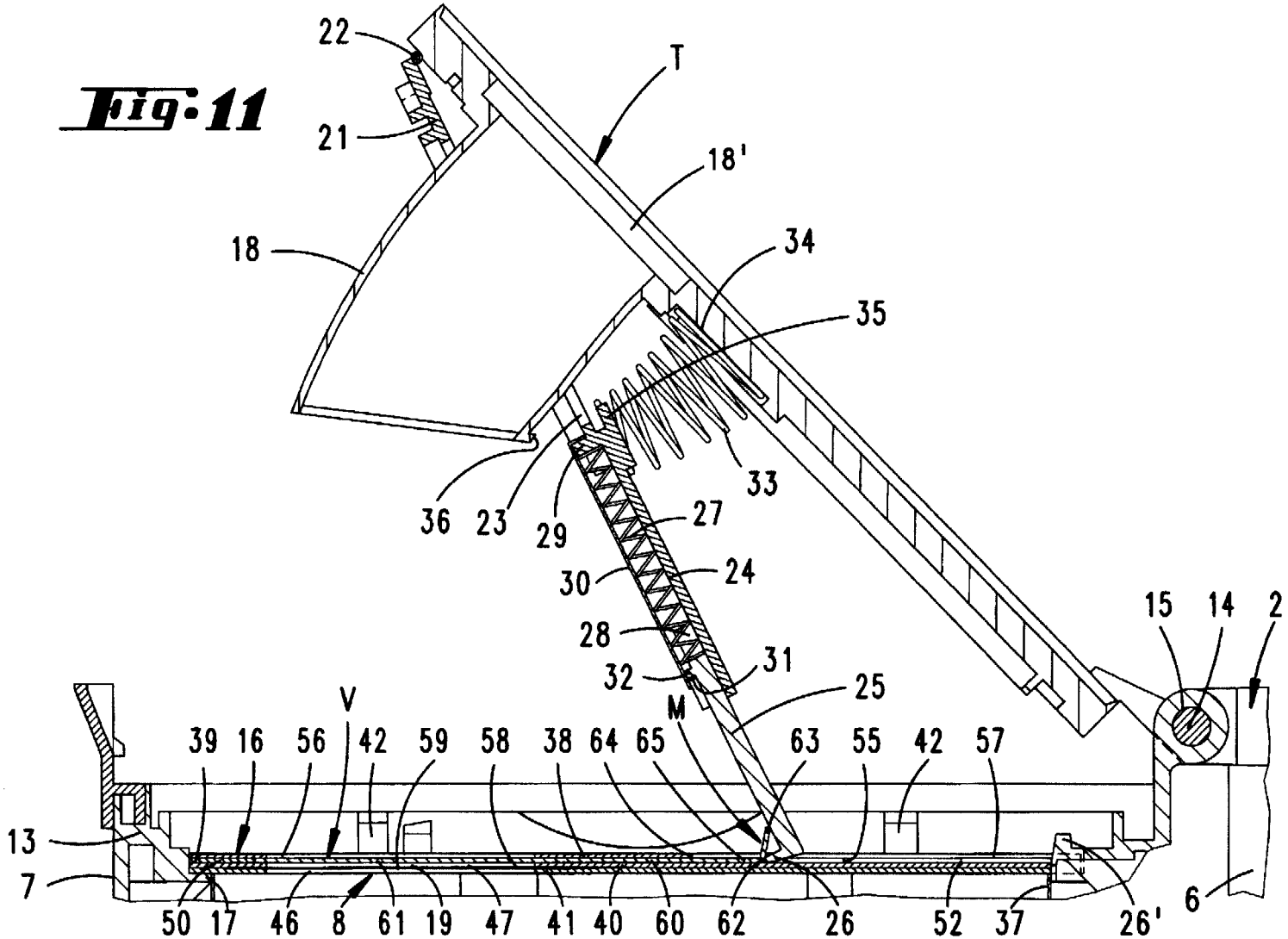
FIG. 11 is a representation corresponding to that of FIG. 3, relating however to a disposition in the course of opening the vacuum cleaner and closing the opening in the mounting plate.

For withdrawal of a dust filter bag 8 provided with a mounting plate 16 of this kind from the chamber 7, the dust bag together with the drag cover T is first of all pivoted out of the operating disposition according to FIG. 1 into a withdrawal position according to FIG. 3. As is to be seen from this drawing, the pivotable plate 21 provided with the actuation projection B is here disposed parallel to the drag cover T between this latter and the mounting plate 16. The actuation nose 26 of the actuation projection B thus engages behind the section 63 of the spade handle 60 of the closure member V, which section 63 may be folded out of the plane of the spade handle. If the drag plate T is subsequently pivoted away from the chamber 7 by means of the handgrip 20, the actuation nose 26 engaging at the foldable-out section 63 then effects a displacement of the closure member V in the closing direction for the opening 19. In the course of pivoting the drag cover T, the plate 21 with the actuation projection B pivots at the same time about the hinge 22, because of the spring 33, in such a manner that the foldable-out section 63 of the closure member V is engaged at all times by the actuation nose 26 at least over a major part of the path of pivoting of the drag cover T. There is effected by this a scissors-type opening action between the drag cover T and the plate 21 provided with the actuation projection B. Because of the actuation arm 25 being spring-biassedly mounted in the receiving chamber 24, this may give way in the course of movement into the receiving chamber 24. The spring-biassed support of the actuation projection B and the spring-biassed pivotability of the plate 21 and the actuation projection B connected to this plate, guarantee at all times that the actuation nose 26 engages behind the foldable-out section 63 over the entire path of displacement of the closure member V. As soon as the closure member V reaches the closed position for the opening 19, the end edge of the closure member V or that of the closure plate 61 abuts, as already mentioned, against the inwardly located peripheral edge of the layer strip 50 of the layer 39. In this disposition, the fold location 62 of the spade handle 60 also reaches the end edge 64 of the recess 57 of the uppermost layer 38. The actuation protection B continues to endeavour, in this dispositions to displace the closure member V further in the direction of the arrow y. The actuation nose 26 thus still continues to engage behind the foldable-out section 63 of the spade handle 60. In the course of the further pivoting of the drag cover T away from the chamber 7, there now takes place engagement of the actuation nose 26 beneath the foldable-out section 63, which section, because of this and because of the urging in the direction of the arrow y, which still continues to prevail, folds out in an upward direction, that is, by moving out through the recess 57 of the uppermost layer 38. By this, there is introduced a second fold location 65 (see FIG. 11). Here it is shown that the spade handle 60 may be formed to be of the same width as the recess 57, but it may also optionally be narrower than this recess, since otherwise the region which is impacted against and gripped beneath by the actuation nose 26 in the disposition shown in FIG. 11 cannot give way outwardly. This would lead to damage of the closure member V in the region of the engagement surface for the actuation nose 26. In so far however as the displacement of the closure member and the action on the spade handle 60 is not effected by way of a folded portion, but only by a handling projection M mounted for example on the spade handle, it is also possible and is preferred for the spade handle 60 to be formed to have a greater width than the recess 57, so that the edges of the recess are engaged from below by the spade handle.

Figure 12:
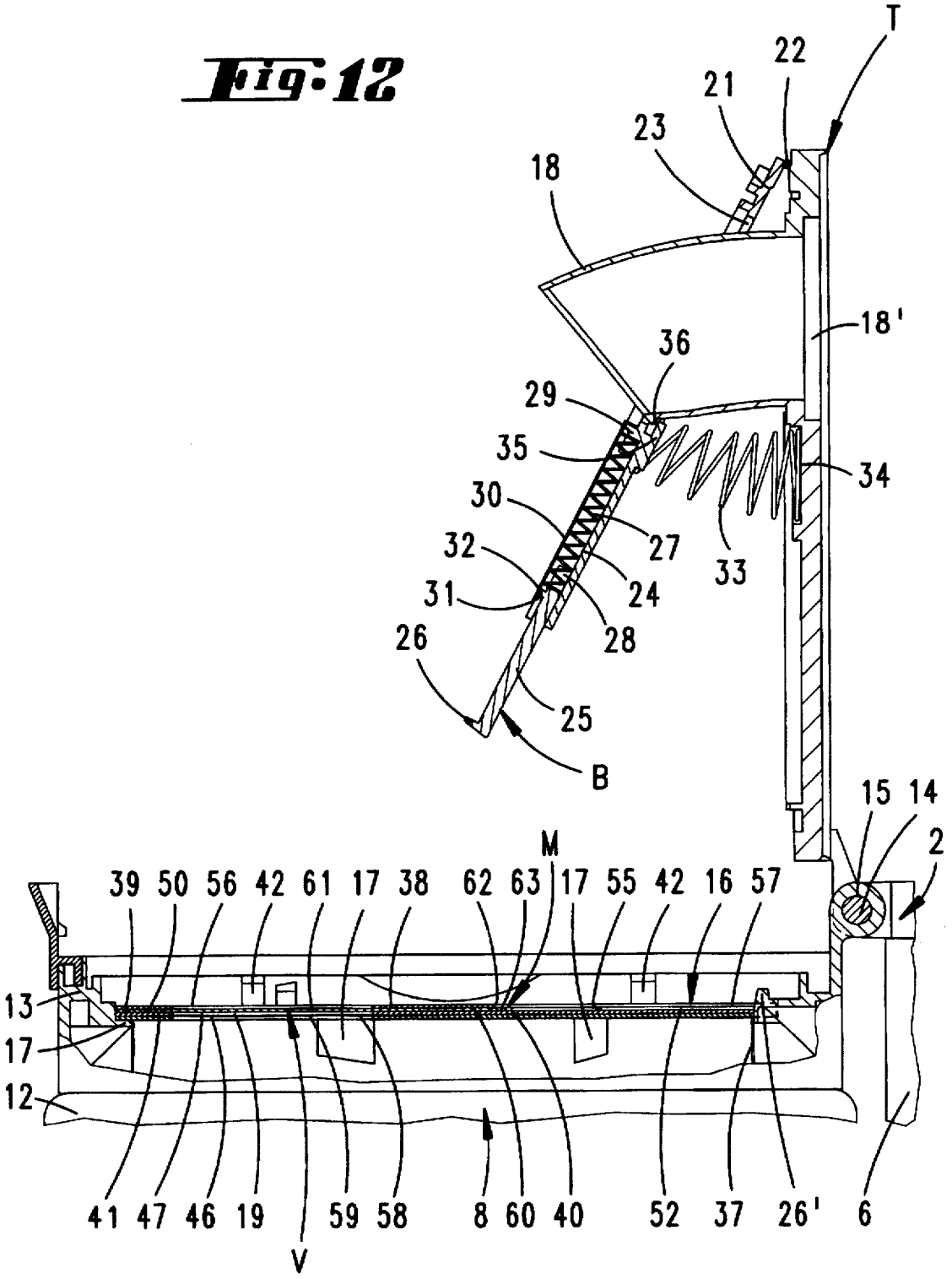
FIG. 12 is a further representation corresponding to that of FIG. 3, relating however to the open disposition of the vacuum cleaner and the closed disposition of the opening in the mounting plate for the dust filter bag.
Figure 13:
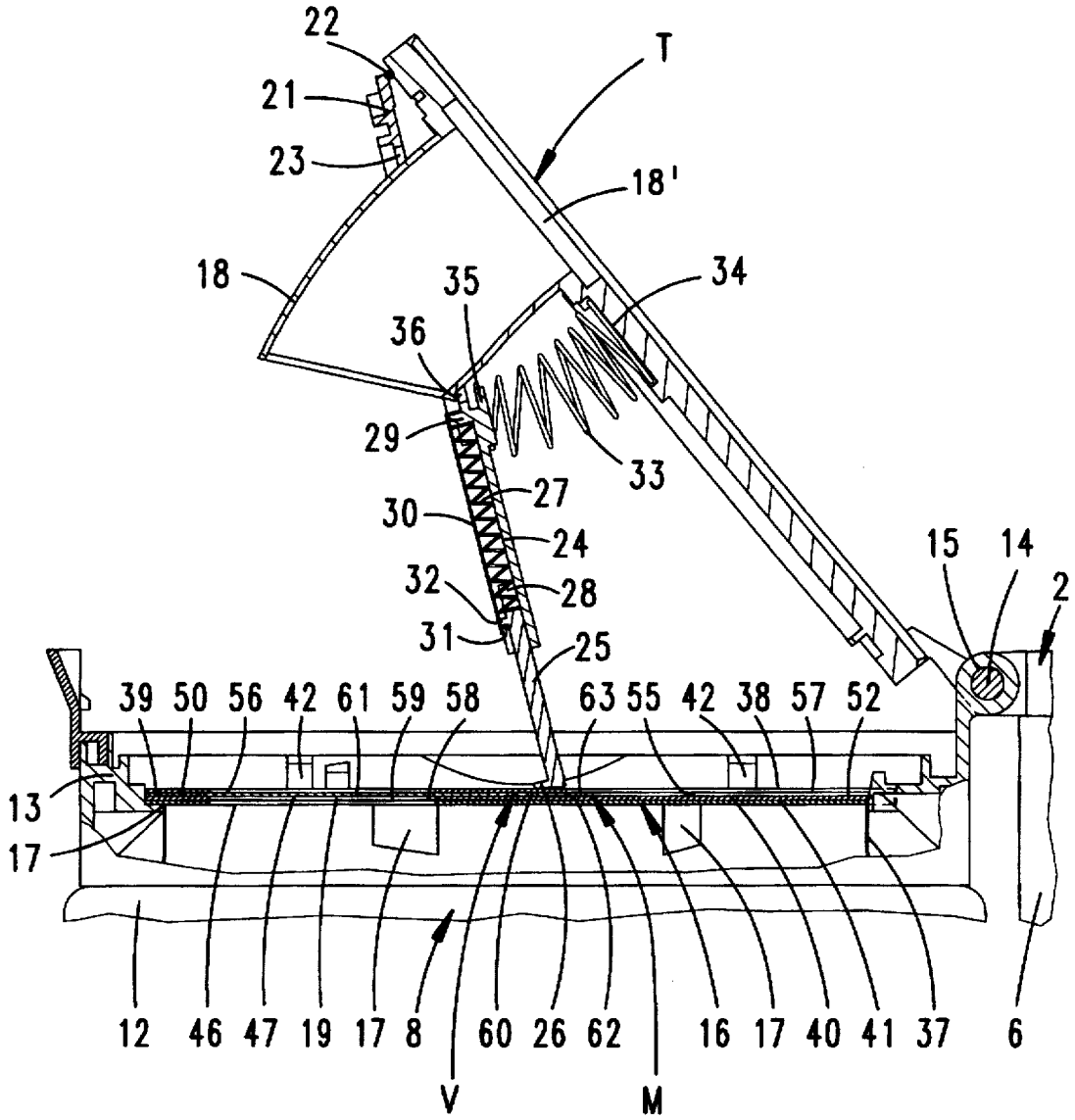
FIG. 13 is a further representation corresponding to that of FIG. 3, relating however to a disposition during the closing of the vacuum cleaner and the opening of the aperture in the mounting plate.

In the course of the further pivoting of the drag cover T into a disposition according to FIG. 12 in which the dust filter bag 8 may be released, the actuation nose 26 of actuation projection B passes over the foldable-out section 63, whereby this latter is moved to an upward location, passing out of the recess 57 of the uppermost layer 38. The actuation projection B reaches in this way a predefined end position, while, as already described, the projection 35 extending into the aperture 23 of the plate 21 abuts against the collar 36 provided on the external periphery of the suction connection 18. The drag cover T may also be pivoted still further than the 90° disposition shown in FIG. 12, so that the dust filter bag 8 may be removed in a problem-free manner from the chamber 7.

For removal of the dust filter bag 8, this is grasped in the gripping opening regions 45 of the mounting plate 16 and drawn out of the chamber 7 against the retaining action of the retaining features 42 of the filter frame 13.

If a closed dust filter bag 8 of this kind is however to be used again, opening of the aperture 19 may be effected in the simplest manner. For this, the drag cover T is pivoted back in the direction of the chamber 7, so that the free end region of the actuation arm 25 of the actuation projection B engages against the fold location 62 located at the end edge 64 of the recess 57 in the mounting plate 16. In the course of the further pivoting of the drag plate T into the closed position, the actuation projection B displaces the closure member V into an open position for the aperture 19, in that the actuation arm 25 pushes the closure member V in front of it, the pushing taking place in the spade handle region 60 of the closure member. As already discussed previously above, the ability to vary the longitudinal location of the actuation projection B against the compression spring 27 is also of particular importance in this connection. Thus, in the event of an inappropriate angular disposition, a potential blocking effect may be introduced by the actuation projection B meeting up with the spade handle 60. Instead of this, the length of the actuation arm 25 is first of all reduced, whereby the actuation angle on the spade handle 60 is also changed, so that any self-arresting or blocking effect which may occur may be overcome. In the further course of the pivotal movement of the drag cover T, there closes also the scissors form arrangement of drag cover T with respect to the plate 21 and also with respect to the actuation projection B mounted on the plate 21. After complete opening of the aperture 19 of the mounting plate 16, whereby corresponding edges of the closure plate 61 abut against the stops 55 of the layer 39, the actuation projection B passes over the foldable-out section 63 in the free end region of the actuation arm 25 and the actuation nose 26 of the arm 25 seats itself once again behind this section 63e In this connection, it is also of importance that the actuation projection 26 travels against a stop 26' fixed to the housing (see for example FIG. 3). This takes place preferably also with the development of a certain level of noise, which signals to the user a correct open condition of the filter bag and altogether a functionally problem-free preparedness of the vacuum cleaner for operation.

The dust filter bag 8 shown and described is, with its mounting plate 16, also insertable in vacuum cleaners 1 which have no arrangement for automatic closing and opening in the course of opening or closing the vacuum cleaner. Here nonetheless there is also the possibility of displacing the closure member V by hand into the respective disposition, in that the foldable-out section 63 is grasped by hand and a displacement of the closure member V may thus be effected. In addition, there is also the possibility of engaging the closure member V in the region of the gripping openings 45, in that the closure member V may be engaged and displaced by means of a clamping grip in the exposed region between the layers 38 and 40. This also functions in the particular example as shown in the embodiment, in which the closure member in the region of the gripping openings 45 reaches only to the edge of the contour of the mounting plate 16 and does not project beyond this contour.

In use of a vacuum cleaner 1 which is provided with an actuation projection B as shown and described, use of conventional dust filter bags may also be envisaged, that is, dust filter bags without closure member V. In this case, the actuation projection B would run out over the mounting plate 16 during pivoting of the drag cover T into an open or closed position, without functions of any kind being carried out.

It is finally also possible for the plate 21 of the drag cover T to be provided with registration projections. These registration projections travel, after completion of pivoting of the actuation projection B, into corresponding registration openings, which in the embodiment shown, may be the gripping openings 45 of the mounting plate 16. For this, the arrangement is such that closure of the vacuum cleaner 1 is only possible when the registration projections have entered into the registration openings or the gripping openings 45. This arrangement is to provide that closure of the vacuum cleaner 1 is only possible when a dust filter bag 8 has been inserted. If a dust filter bag 8 is inserted into the chamber 7, the actuation projection B pivots, as already described, in the course of the closing movement, in the direction of the underside of the drag cover T, whereby the registration projections are also correspondingly displaced to such an extent that they may enter into the corresponding registration openings or gripping openings 45 in the closed disposition of the chamber 7 with respect to to the drag cover T. If however no dust filter bag 8 is introduced, the actuation projection B finds no opposition to pivoting, so that the registration projections remain in their blocking position. In this blocking position, these projections abut for example against the outer edge of the filter frame 13 in the course of the closing movement of the drag cover T, so that there is opposition to closing the vacuum cleaner 1. If now also, differently sized registration projections are associated with correspondingly differently sized registration openings, a locationally correct insertion of the dust filter bag 8 in the chamber 7 is also assured.

Figure 15:
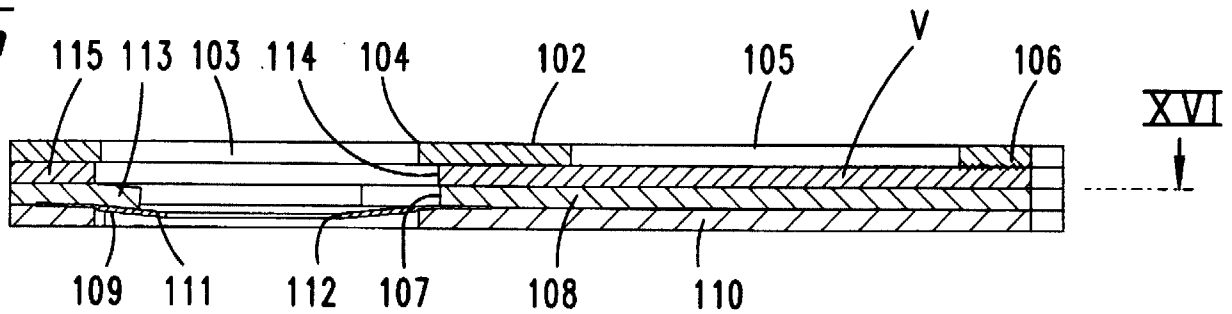
FIG. 15 is a cross-section through the arrangement of FIG. 14, the section being taken on the line XV—XV.
Figure 14:
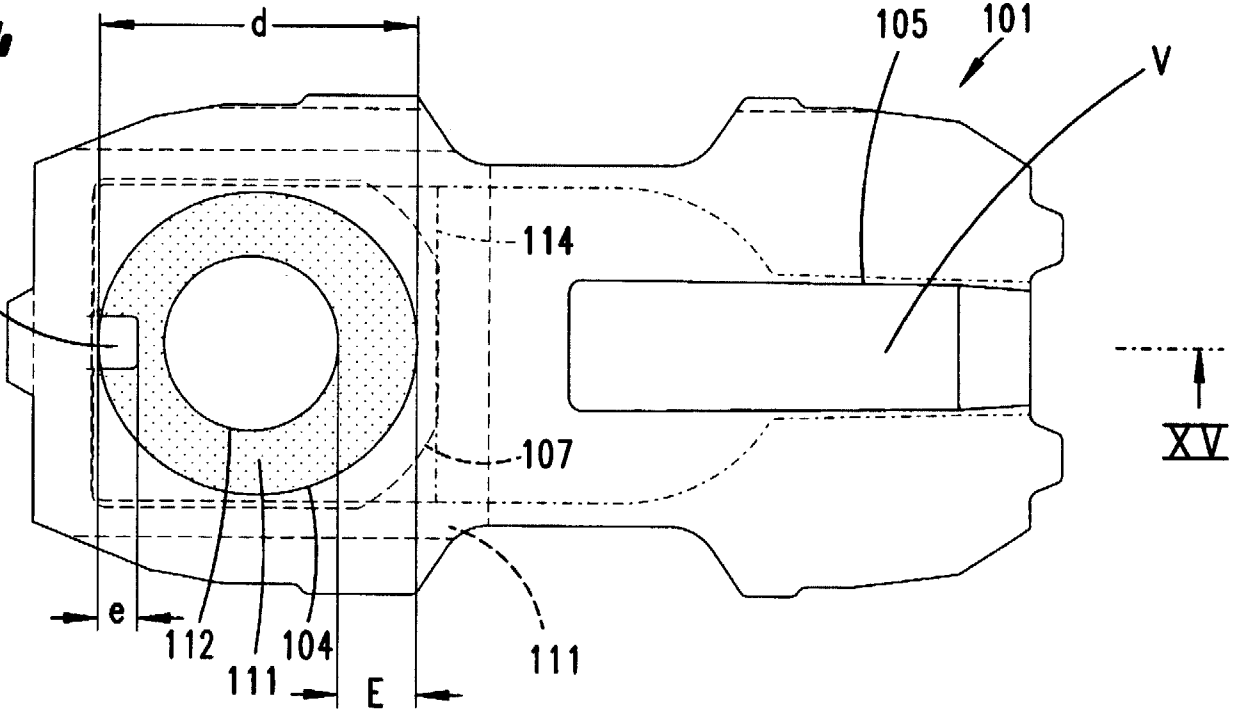
FIG. 14 is a plan view of the mounting plate for a dust filter bag with an opened push-closure.

There is shown and described, initially with reference to FIG. 14, a mounting plate 101 for a dust filter bag. The mounting plate 101 is, as may be seen from FIG. 15, formed from a total of four layers (FIG. 15 is a greatly enlarged representation). An upper layer 102 has a circular opening 103 with a peripheral edge 104. In addition, a relatively wide slit 105 is provided in the upper layer 102. Underneath the upper layer 102, there is a provided a displaceable closure member V. The closure member V is provided at its narrow end with an attachment 106, which in the embodiment also comprises a card layer. The attachment 106 projects into the slit opening 105. By means of this attachment 106, the closure pusher V may be displaced by hand or automatically.

The closure pusher V is indicated in FIG. 14 as to its external dimensions by the dotted lines. The opening 107 of the middle layer 108, i.e. the third layer from the top of the mounting plate 101, is formed to be larger than the upper opening 103 and also larger than the lower opening 109 (see FIG. 15). A rubber seal 111 is mounted between the layer 108 and the lowermost layer 110 of the mounting plate 101. The rubber seal 111 may for example be secured between the layers 108 and 110 by gluing. The rubber seal 111 extends inwardly from the peripheral edge 104 in annular manner and has an inner peripheral edge 112.

A stabilising portion in the form of a tongue 113 is provided on the middle layer 108, i.e. the third layer from the top of the mounting plate 101. The tongue 113 is provided at the location on the opening 103 which is most remote from an end edge 114 of the closure member V (with reference to the withdrawn position of FIG. 14).

By the provision of the tongue 113 on the layer 108 of the mounting plate 101, it follows that this may also comprise a card-paper material, in the case of the present embodiment, as also applies for the remaining layers of the mounting plate.

The tongue 113 has a dimension e, proceeding from the peripheral edge 104 towards the interior of the opening 103, which dimension corresponds to one-half of the dimension E of the rubber seal 111 from the peripheral edge 104 towards the interior of the opening 103. For the present embodiment, a diameter d of the circular opening 103 is approximately 5 cm. The dimension e corresponds approximately to one-tenth of this diameter, thus approximately 5 mm, while the rubber seal 111 extends approximately 1 cm into the interior of the opening 103 (dimension E).

Figure 16:
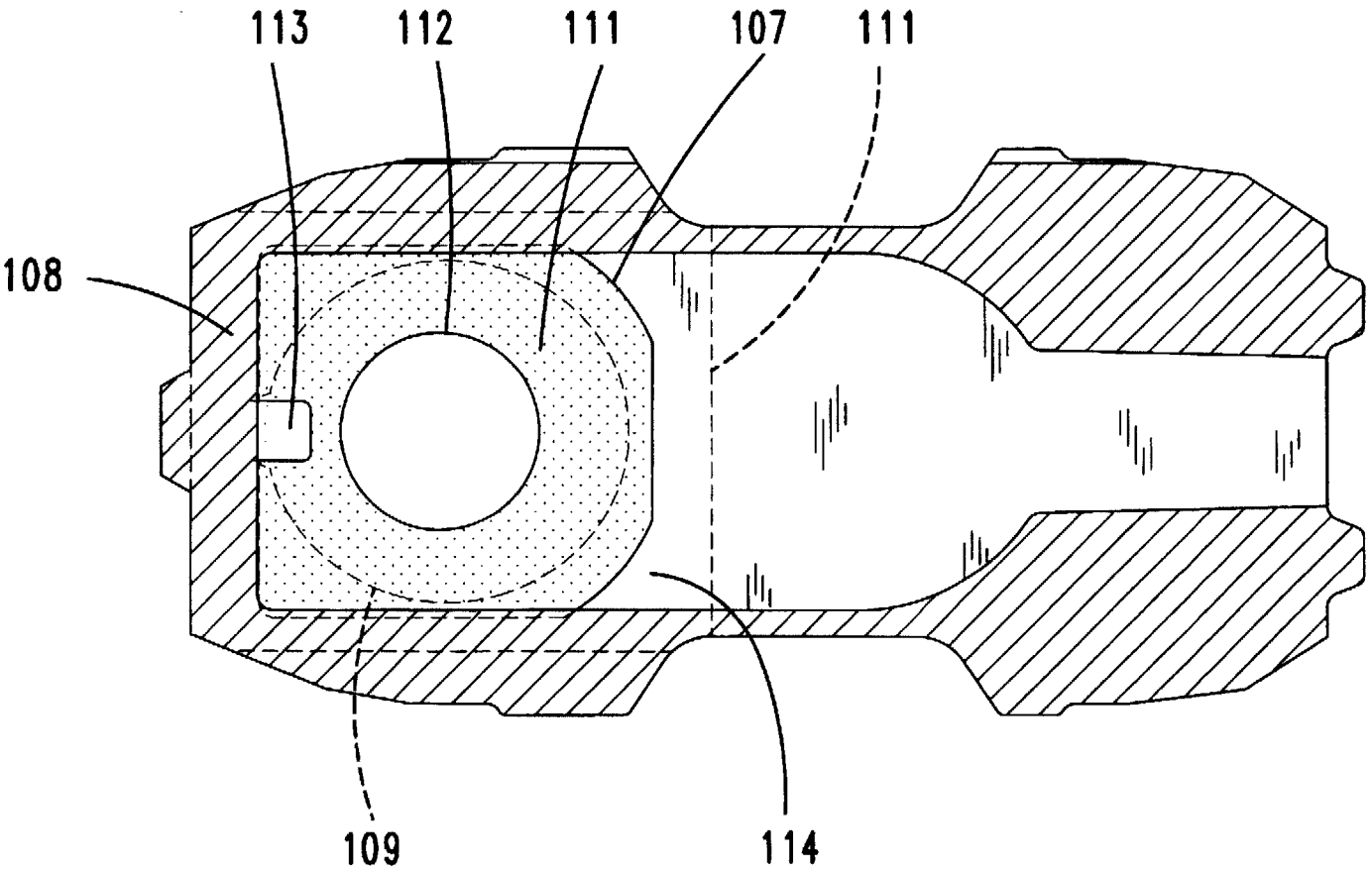
FIG. 16 is a representation corresponding to that of FIG. 14, following removal of the cover layer.

The sectional view of FIG. 16 shows a section in the plane between the layer 115, the second layer from the top, and the layer 108. In order to indicate that these layers are glued to one another and thus are connected to one another, the section plane, in so far as it coincides with the gluing, is indicated by cross-hatching.

It will be apparent that the tongue 113 is provided directly on the layer 115. The rubber seal 111 is mounted between the layer 115 and the layer 108, the outer periphery of the rubber seal extending only partially circularly.

Figure 17:
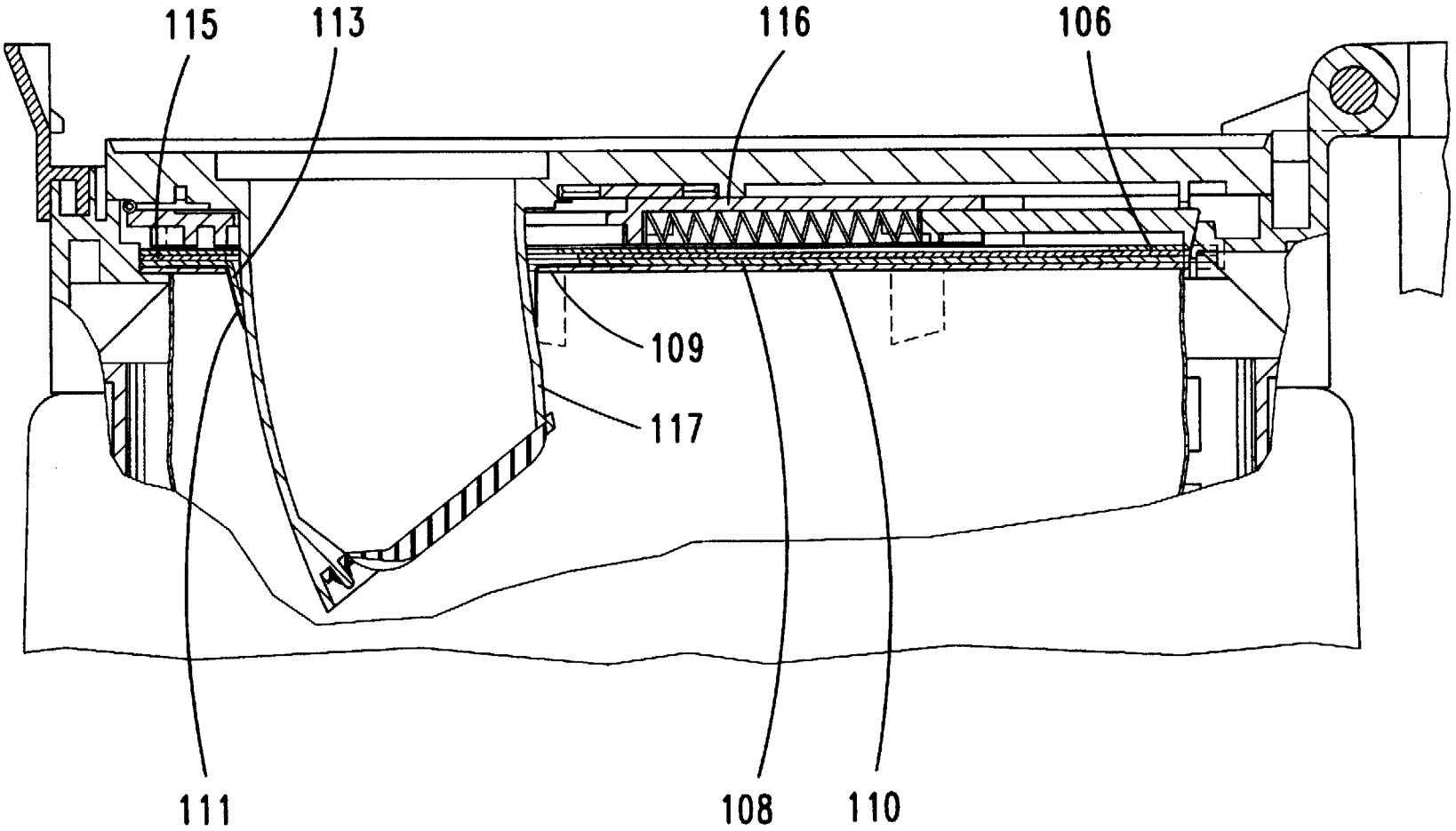
FIG. 17 is a cross-section through a dust filter bag inserted into a vacuum cleaner, the dust filter bag having a mounting plate in accordance with FIGS. 14 to 16.
Figure 18:
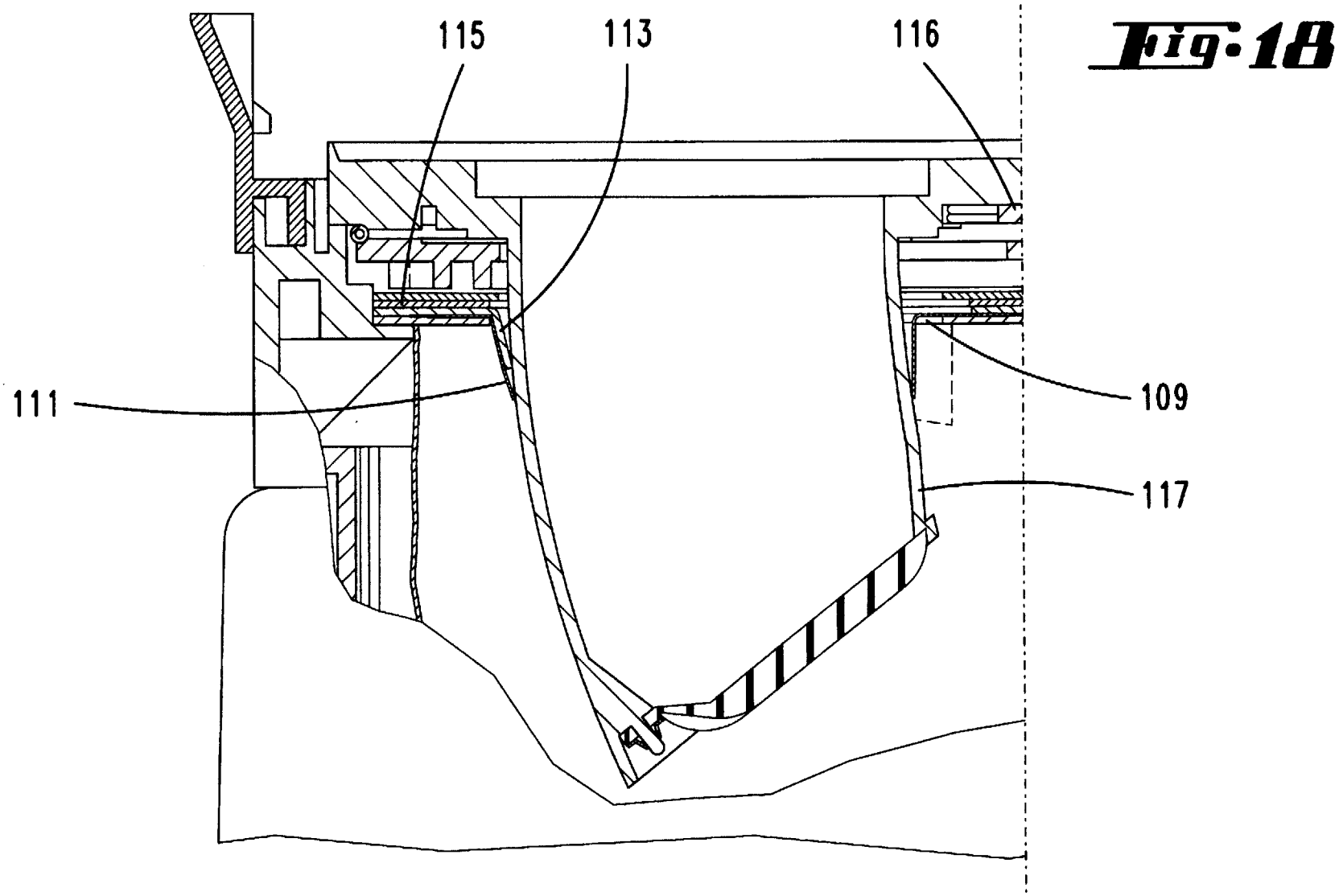
FIG. 18 is a partial enlargement of the representation of FIG. 17, in the suction tube region of the vacuum cleaner.

From the representations of FIGS. 17 and 18, the behaviour of the tongue 113 and the action of the tongue 113 in the operating condition of the vacuum cleaner will be apparent.

There is in question in this case in particular a vacuum cleaner having a so-called drag cover 116, on which a suction tube 117 is provided. In regard to the features of the vacuum cleaner in detail, reference is made for example to EP-A-25 32 057, the content of which is herewith incorporated fully in the disclosure of the present application, also for the purposes of inclusion of such features in the claims.

The suction tube 117 penetrates the openings 103 and 109 as well as the openings of the layers of the mounting plate 101 disposed between these openings. The dimensions of the openings and in particular the dimension of the tongue 113 are determined in relation to the diameter of the suction tube 117 in such a way that a folding of the tongue 113 into the interior of the dust bag is achieved. The tongue 113 engages however completely over the seal 111—and furthermore extends radially inwards—and abuts in a fully engaging manner against the suction tube 117. On withdrawal of the suction tube 117 from the mounting plate 101 of the dust filter bag, there remains because of the bending of the tongue 113 which has taken place, a definite pre-stress in the inward direction and a corresponding action of the tongue 113 on the rubber seal 111. This has the result that the rubber seal 111 does not in any way extend upwardly towards the opening 103 and thus the closure member V may be moved into a closed disposition without any further action. In the closed condition, the closure member V runs onto the tongue 113 on its upper side, with reference to a representation in accordance with FIG. 15.

Figure 19:
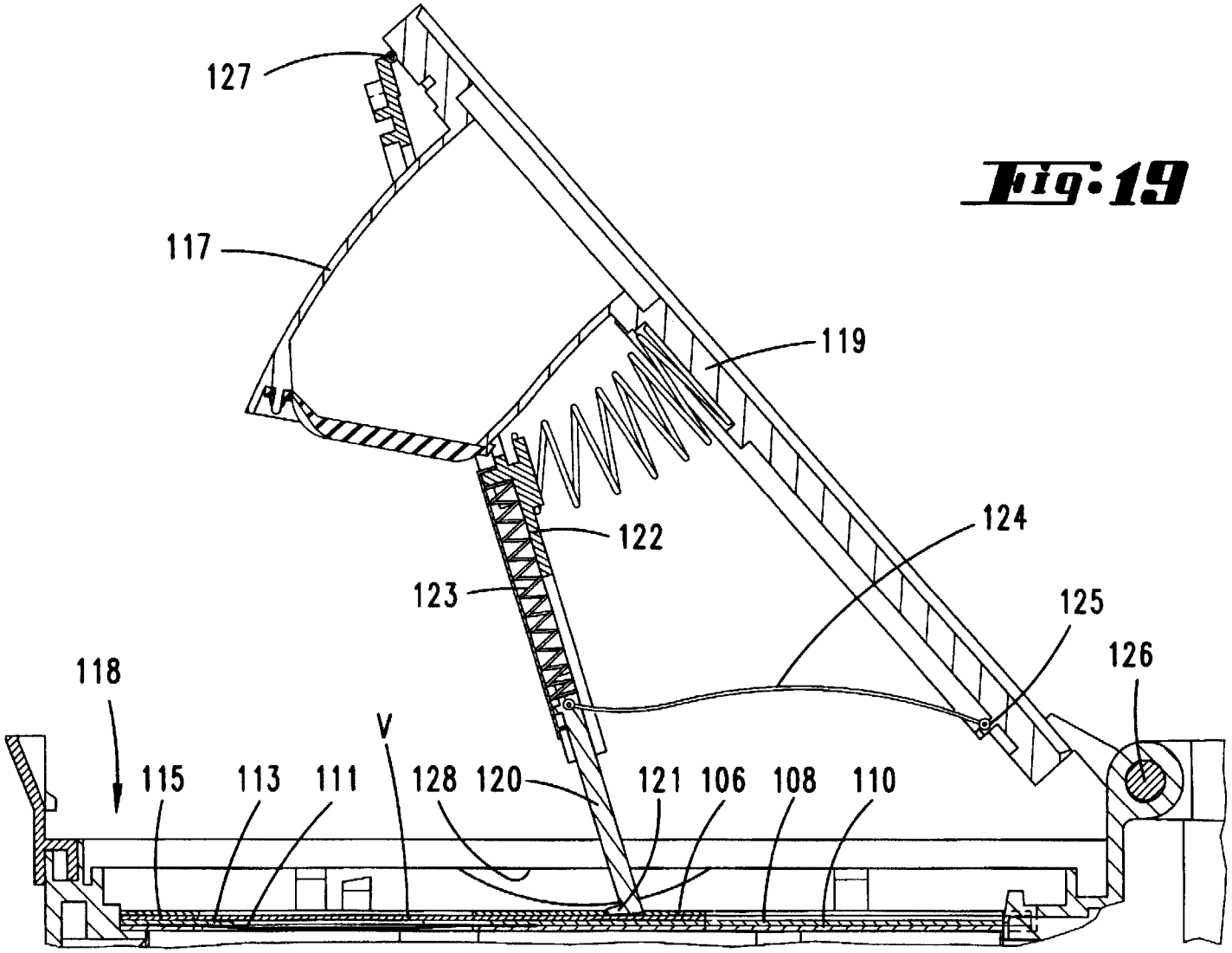
FIG. 19 is a cross-sectional representation of the receiving portion for the dust filter bag with a closure plate and a spring-biassed actuation projection in a connecting arrangement, the actuation projection being in an extended disposition.
Figure 20:
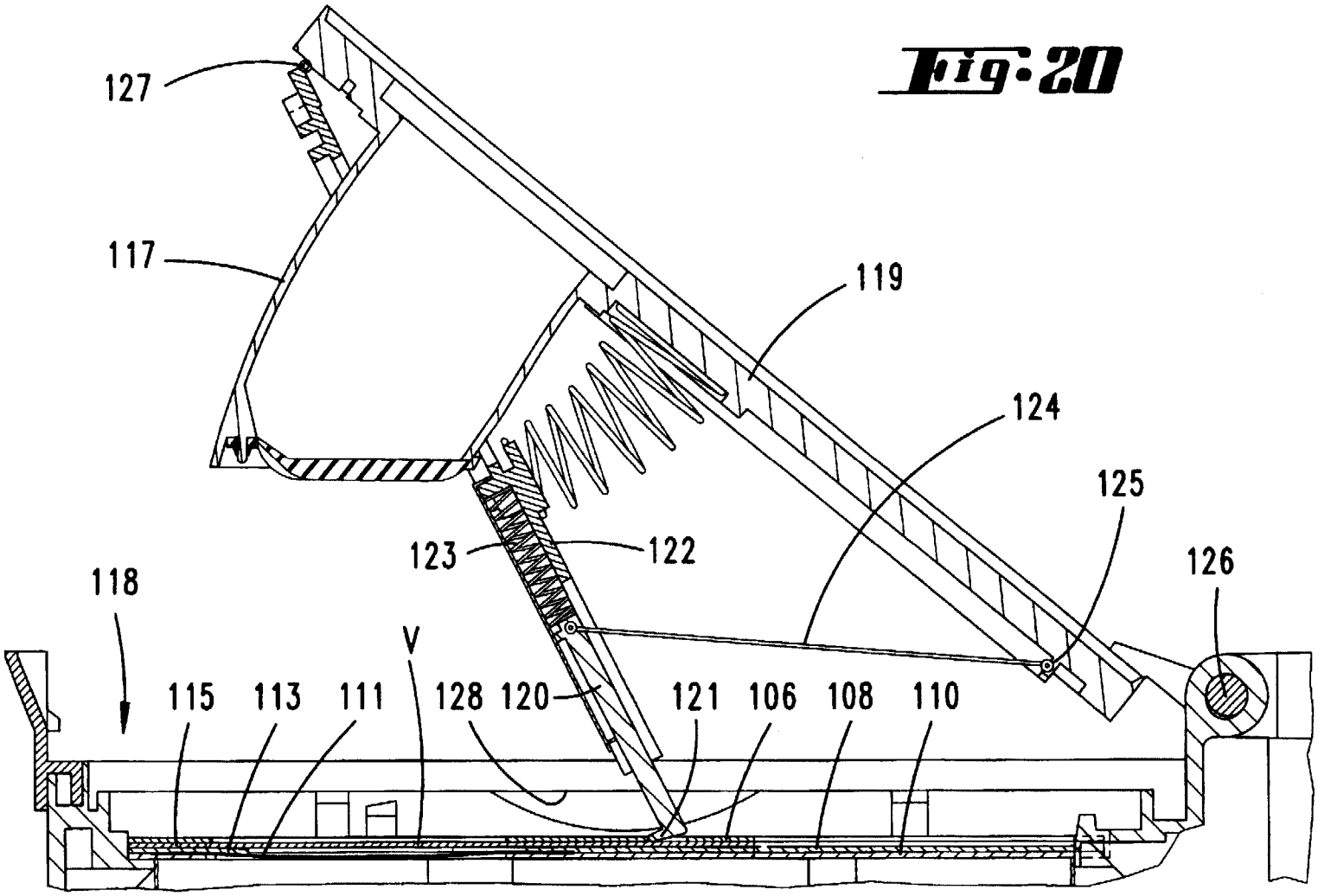
FIG. 20 is a representation corresponding to that of FIG. 19, the actuation projection being in a partially retracted disposition.
Figure 21:
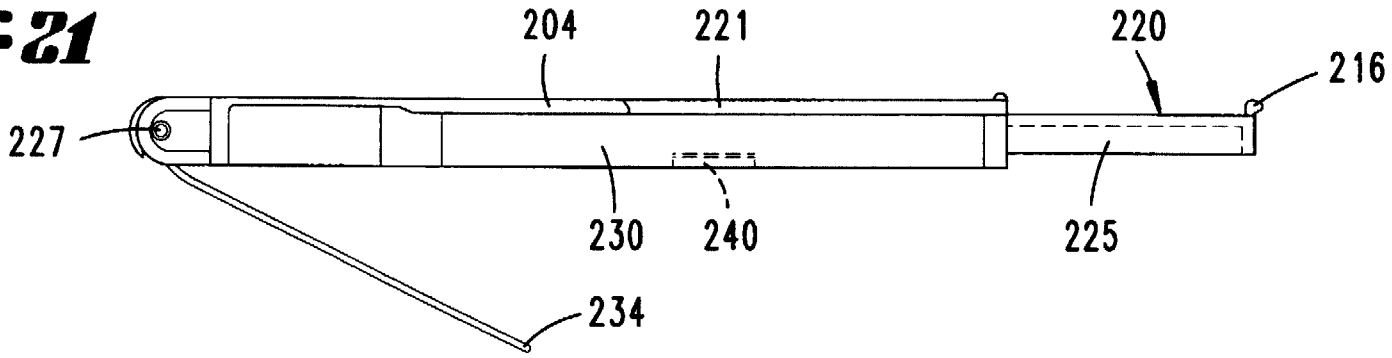
FIG. 21 shows a second embodiment of an actuation projection for a vacuum cleaner, in individual representation, the projection being provided with a plate, and the representation being shown in side view.
Figure 22:
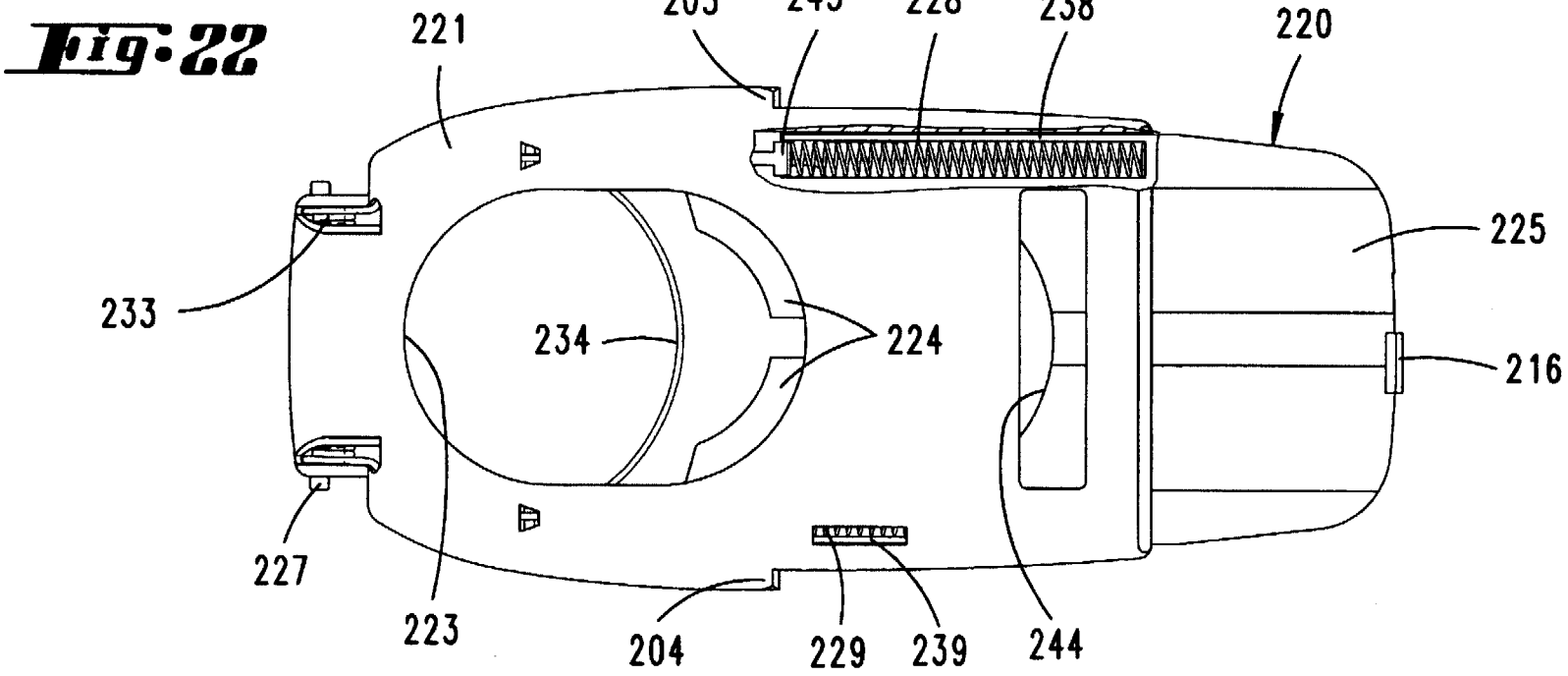
FIG. 22 shows the arrangement according to FIG. 21, but in plan view.
Figure 23:
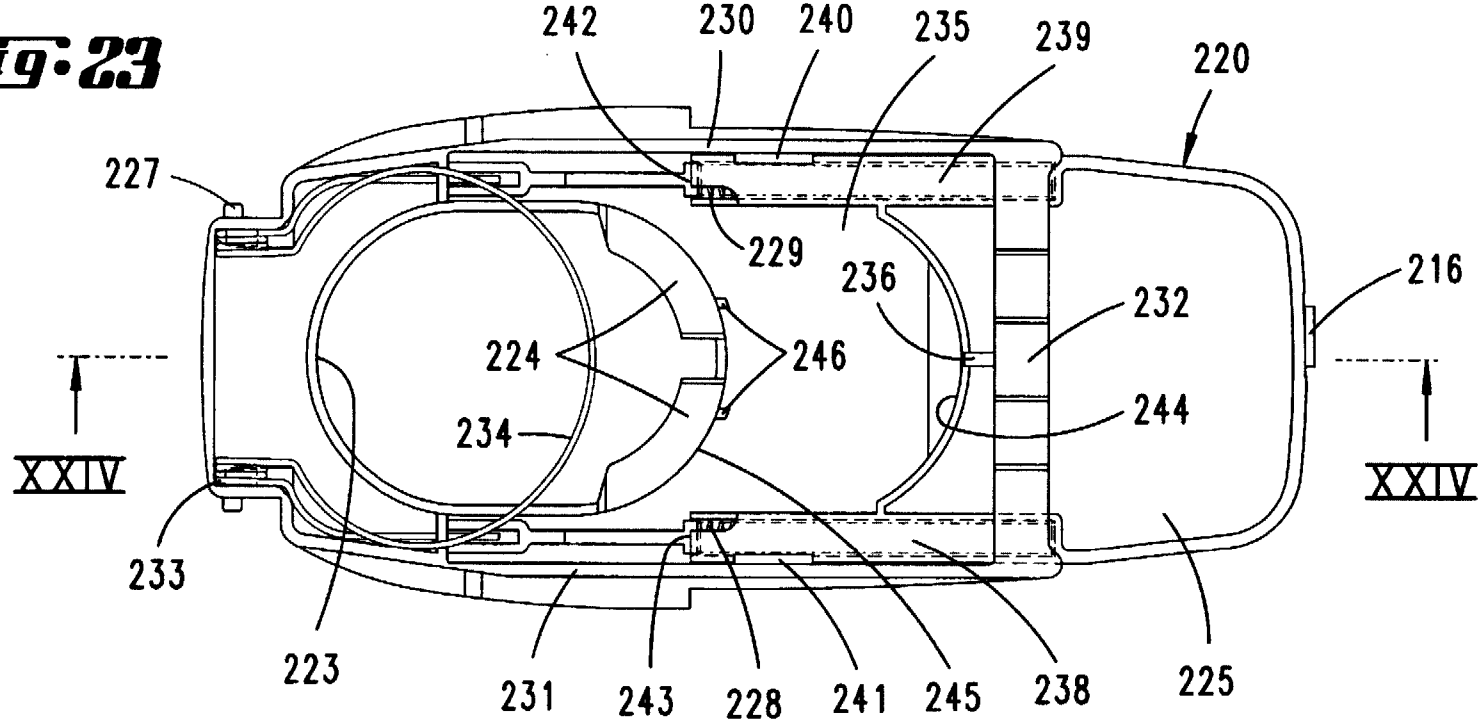
FIG. 23 shows the arrangement according to FIG. 21, in a view from below.
Figure 24:
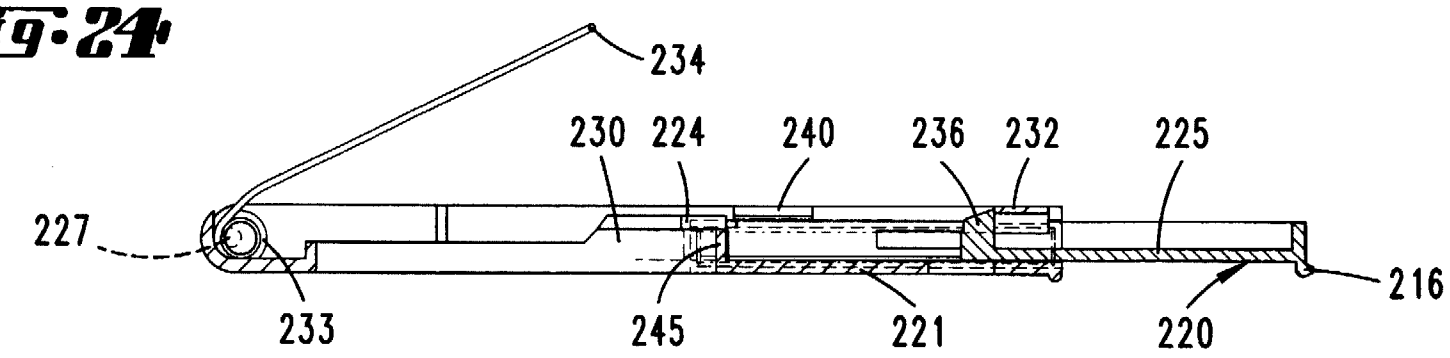
FIG. 24 is a section on the line XXIV—XXIV of FIG. 23.
Figure 25:
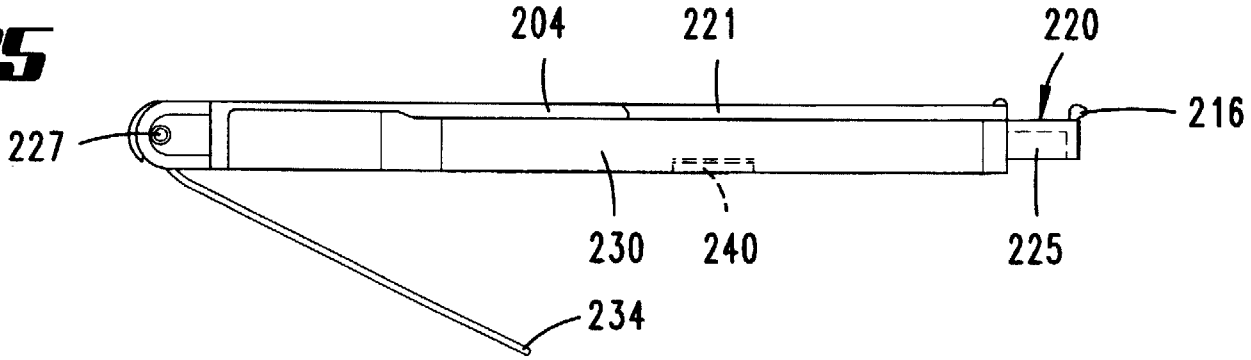
Figure 26:
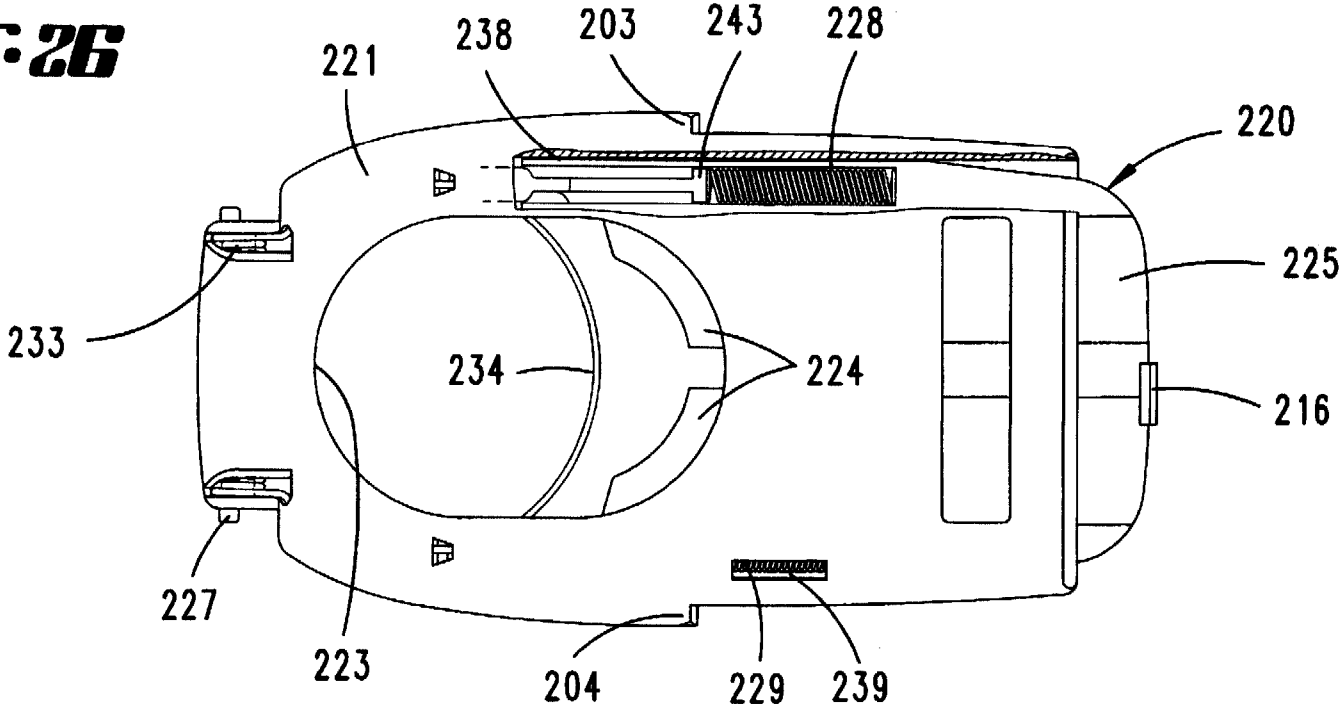
FIG. 26 shows the arrangement according to FIG. 25, but in plan view.

Referring to FIGS. 19 and 20, there is shown in partial cross-section, a receiver 118 for a dust filter bag. In regard to the dust filter bag, there is to be seen in detailed cross-section, a mounting plate 101, as already described above.

The vacuum cleaner or the receiver 118 comprises a solid plate 119, which has the suction tube 117 already discussed In addition, an actuation projection 120 is to be seen, which has a nose 121, by which the projection acts on the closure member V of the dust filter bag. The actuation projection 120 is displaceable in a receiver 122 against the force of a spring 123. In addition, the closure pusher 120 is directly connected to the closure plate 119 by means of a strap 124. In particular, the connection point 125 for the strap 124 is provided on the underside of the closure plate 119, close to a pivot joint 126.

For the position shown in FIG. 19, in which the actuation pusher 120 only rests on the mounting plate 101 of the dust filter bag, the strap 124 is in an unloaded condition. It still has a certain increment of length, which may be used.

For the position shown in FIG. 20, a pivoting movement of the closure plate 119 has been initiated, so that this pivots about the axis of the joint 126 towards the mounting plate 101 for the dust filter bag. During this movement, the relative position of the actuation projection 120 with respect to the mounting plate 101 initially remains unchanged. The actuation projection 120 moves only a little against the spring force of the spring 123 into the actuation projection receiver 122. This movement may continue until such time as the strap 124 is stretched. This stretching occurs before the maximum amount of inward travel of the actuation projection 120 into the receiver 122 has been used up. As soon as the strap 124 is stretched, a dragging away of the actuation projection 120 is introduced by any further pivoting of the closure plate 119 about the axis of the joint 126, so that this projection 120 pivots by means of the receiver 122, into a closed disposition about its joint arrangement 127 relative to the closure plate 119, which is located on the underside of the closure plate 119.

In this way, there is prevented any further increase in the force applied by the actuation projection 120 to the mounting plate 101 for the dust filter bag.

In addition, reference is also made to the unpublished contents of German Patent Application No. 43 41 248 for the general construction of the receiver and the closure plate and the actuation projection.

Alternatively, which however is not illustrated in detail, supports may also be formed on the actuation projection 120 at the side, i.e. perpendicular to the plane of the drawing. These supports may come for example into abutment against the inner periphery 128 of the receiver 118 for the dust filter bag. By a suitable relationship between the overall length of the actuation projection 120 and the arrangement of the supports, it may be achieved not only that the nose 121 of the actuation projection 120 comes into abutment against the mounting plate 101 for the dust filter bag, but also that on the described pivoting of the closure plate 119, the resulting increased force in the course of the linear resilient compression of the actuation projection 120 is taken up by the abutment edge 128. The receiver edge 128 or the supports which are formed on the sides of the actuation projection 120, may then in particular also be so formed that they slide on one another with the least possible frictions For a further embodiment, a closure plate 219 having a suction connection 217 is pivotably mounted in known manner by way of a pivot joint 226 relative to a vacuum cleaner housing 202. An actuation projection 220 on a plate 221 is pivotably mounted by way of a hinge 222 at the free end of the closure plate 219. An expansion spring 233 is located at the axis 227 of the hinge 222, which abuts against the underside 237 of the closure plate 219 by means of a loop 234, the loop matching the annular shape of the suction connection 217 and enclosing this connection. By virtue of the force of the expansion spring 233, when the closure plate 219 is opened, the plate 219 and the plate 221 take up a narrow V shape. The angle of opening of this V shape is limited by abutment of a nose 224 formed in the shape of an L against this connection 217, the nose adjoining an oval aperture 223 for the connection 227, see FIG. 27.

The suction connection 217 is provided with a flap valve 205 at its free end, which prevents the falling back of dust and dirt arising out of the inverted disposition of the dust filter bag 208 in the operating configuration. There is in question in this regard a membrane reinforced by ribs, which is simply riveted in place at a pin 218.

The plate 221 pivotably mounted on the underside 237 of the closure plate 219 carries an actuation projection 220 mounted for displacement against the force of two springs 228, 229. In the extended disposition, the contour line of the plate 221 with extended actuation projection 220 corresponds approximately to the contour shape of the closure plate 219 or that of the inner side of the filter frame 213 receiving the closure plate 219 and plate 221. This means that the actuation arm 225 has approximately the same width as the plate 221. At its free end, the actuation arm 225 carries an actuation nose 216, slightly displaced off centre, which nose moves a closure member V of a mounting plate 201 for the dust filter bag 208 along with the nose in the manner described above.

The mounting of the actuation projection 220 on the plate 221 is explained in more detail with reference to FIGS. 21 to 26. The plate 221 has perpendicularly extending shanks 230, 231 on which the the actuation projection 220 is mounted at its sides, the shanks being connected at their free ends by means of a bar 232 at the opposite end from the axis 227. The actuation arm 225 of the actuation projection 220 is guided between the underside 235 of the plate 221 and the bar 232. A retaining nose 236 abuts against the bar 232 on extension of the springs 228, 229 and prevents the arm from being withdrawn. The springs 228, 229 are mounted in channels 238, 239 of the actuation projection, the channels being formed to be U-shaped in cross-section. The free shank ends of the channels 238, 239 lie against the underside 235. For better guidance of the actuation projection, there extend from the free shanks 230, 231 of the plate 221, projections 240, 241, so that the channels 238, 239 are provided between these projections and the underside 235. In the longitudinal direction, each channel 238, 239 is closed at one end by a wall, against which the springs 228, 229 abut. The opposite longitudinal end is open and the springs 228, 229 there abut against counterbearings 242, 243 secured to the plate. When the dust filter bag 8 is closed, the actuation projection 220 is initially pushed in the direction of the aperture 223 against the force of the springs 228, 229. The aperture 223 is thus located between the channels 238, 239, and the actuation arm 225 connecting the channels 238, 239 may therefore have a rounded shape 244. For limiting the displacement of the actuation projection 220 towards the aperture 223, abutments 246 are provided on the wall 245 of the nose 224, against which the end face of the rounded portion 244 of the actuation projection 220 engages.

Figure 9:
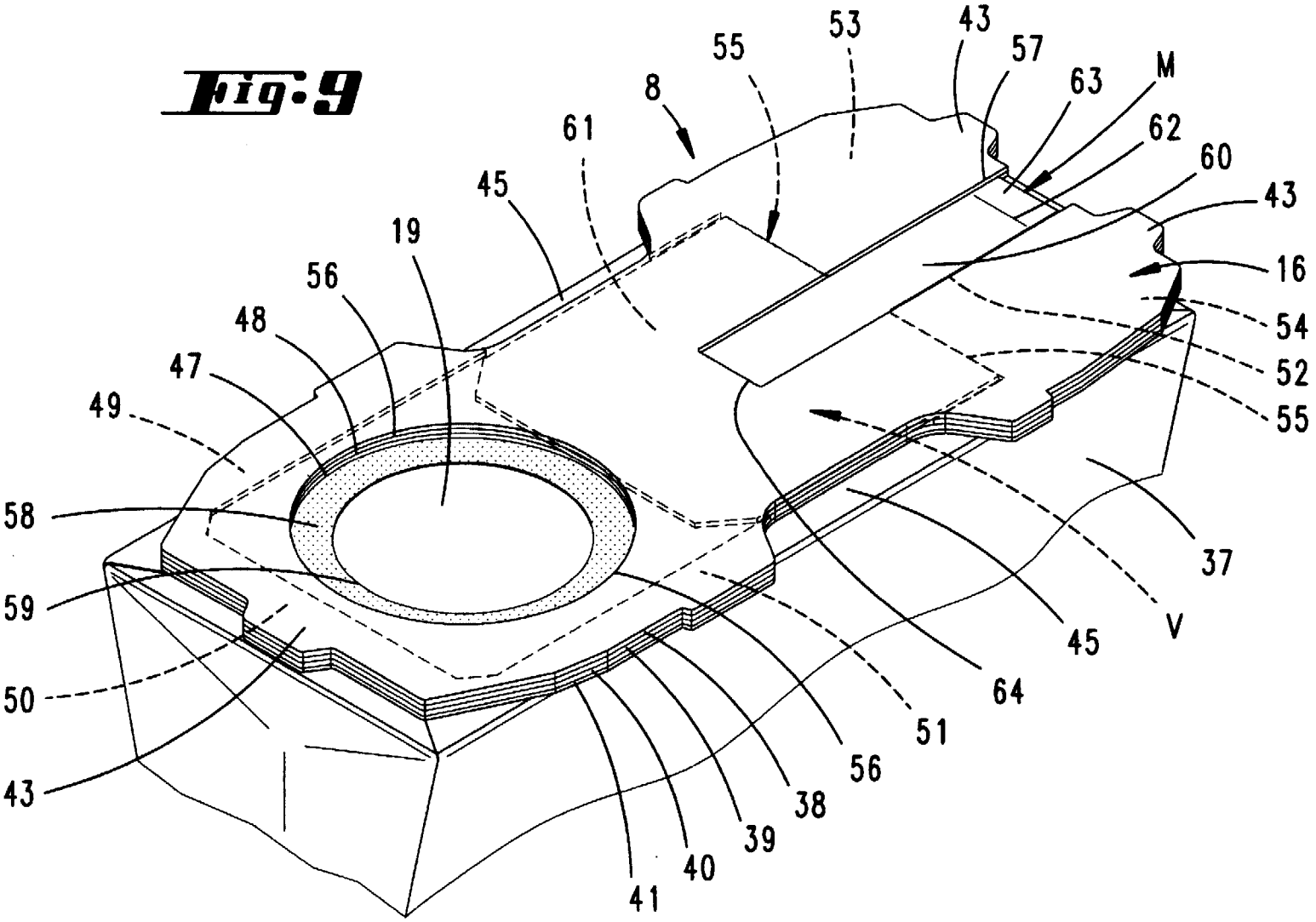
FIG. 9 shows the upper region of the dust filter bag with its mounting plate, in perspective individual representation, in an open condition.

The mounting plate 201 with the closure member V is formed substantially in accordance with the preceding embodiments. It has here however a handling projection for the spade handle 260 in the form of an attachment 261, see FIG. 28, which is connected to the uppermost layer of the mounting plate 201, this layer forming the top. The width of the attachment 261 corresponds to somewhat less than the width of the slit in the uppermost layer of the mounting plate 201, see in this connection also FIG. 9, which is necessary for the actuation of the closure member V. The actuation nose 216 of the actuation projection 220 projects in the direction of movement, towards the angular space formed by the upper side of the spade handle 260 and the longitudinal side of the attachment 261, so that a counterbearing is found. As an alternative to the attachment, a recess may also be provided.

Figure 27:
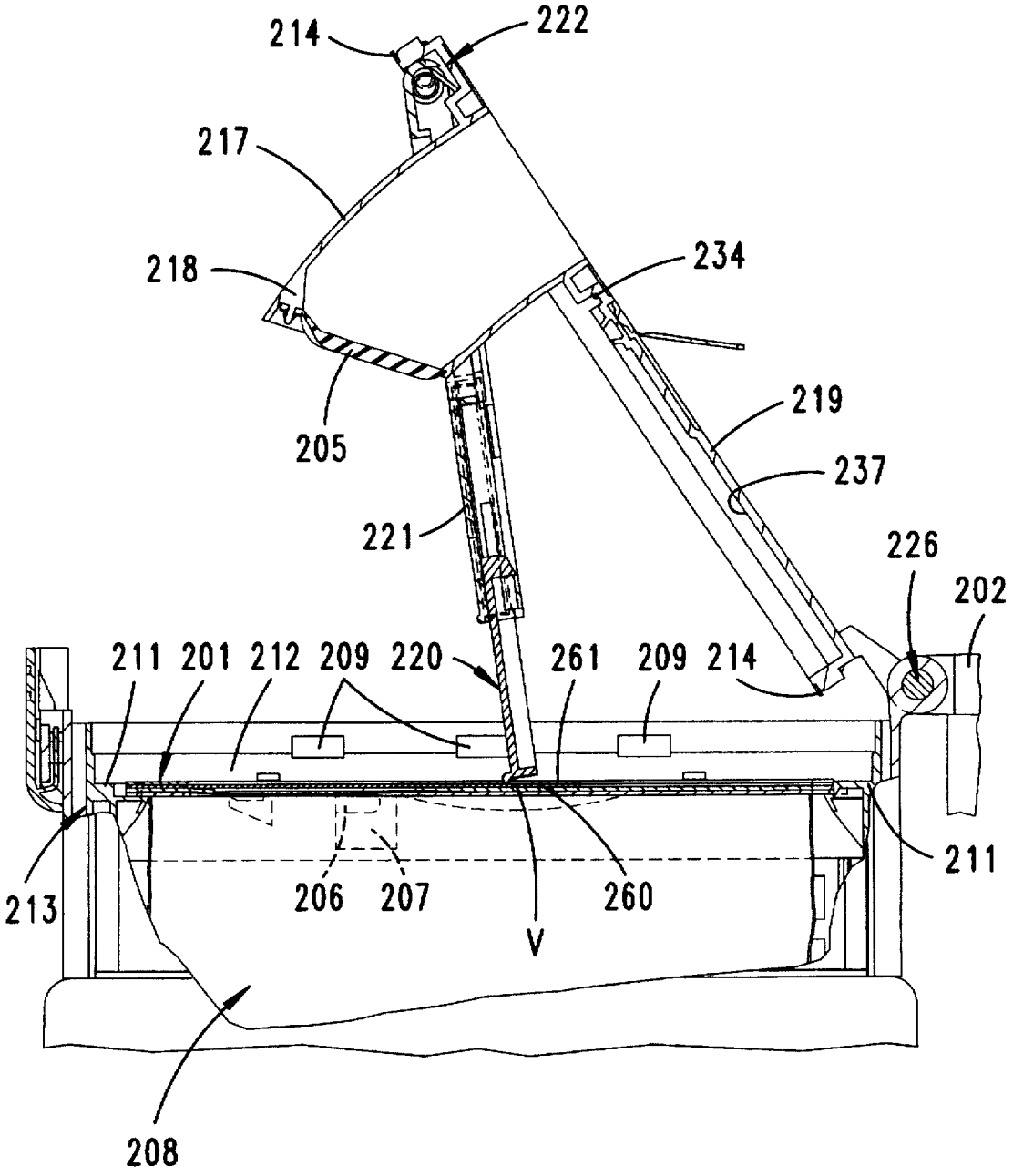
FIG. 27 is a cross-sectional representation of the receiving portion of the dust filter bag with a closure plate and the actuation projection according to FIG. 21, the actuation projection being in an extended disposition.
Figure 28:
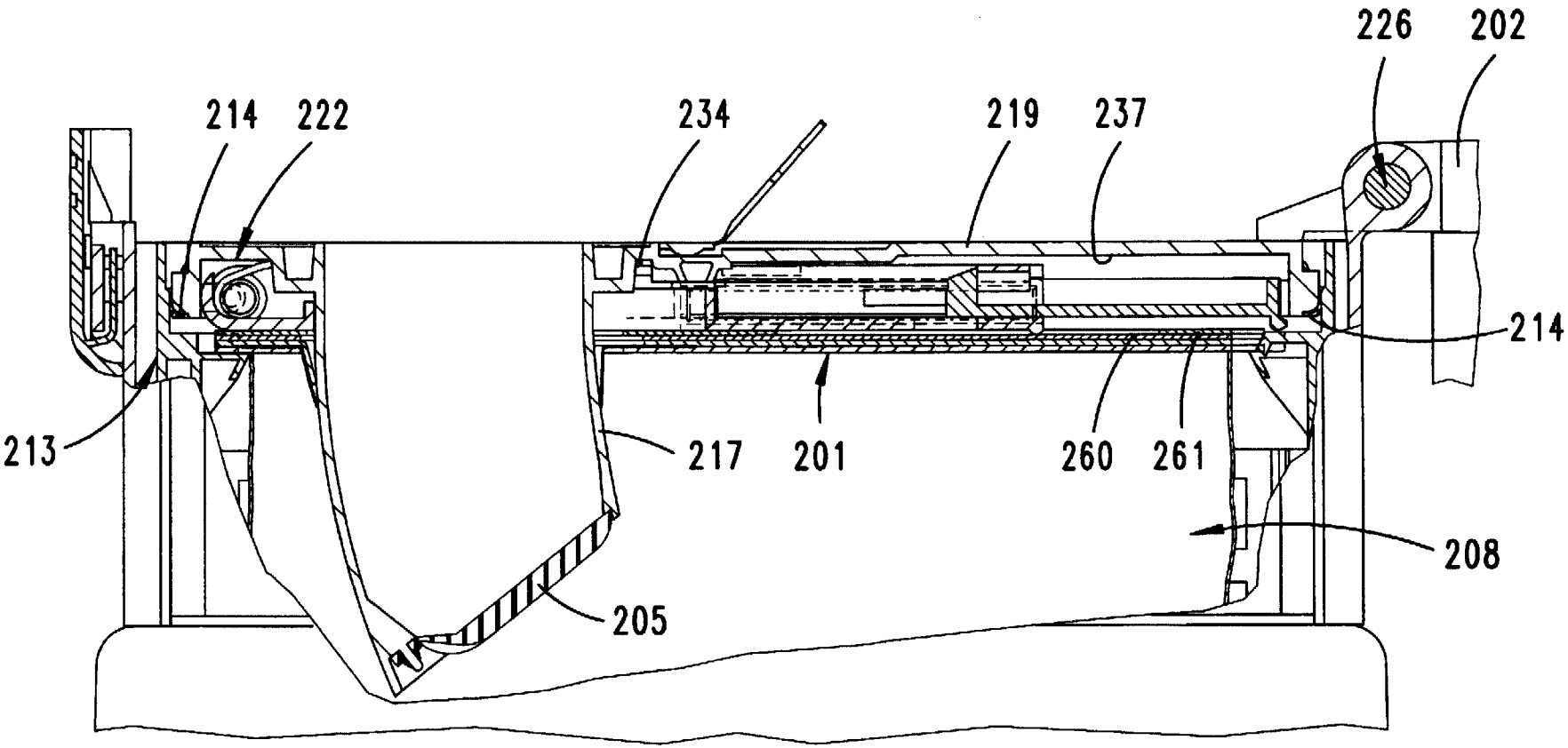
FIG. 28 is a cross-sectional representation of the receiving portion of the dust filter bag with a closure plate and the actuation projection according to FIG. 21, the closure plate being mounted in the filter frame.

On pivoting the closure plate 219 inwardly out of the position shown in FIG. 27 into the position according to FIG. 28, the plate 221 and the actuation projection 220 abut against the underside 237 of the closure plate 219, if the mounting plate 201 is missing and there is therefore maintained the V disposition between the closure plate 219 and the plate 221 and the actuation projection 220, it is not possible to close the closure plate 219. Registration projections 203, 204 on the plate 221, formed by a widening opposite to the free end of the plate 221 and the actuation projection 220, move on maximum pivoting into registration receiving portions 206 of inwardly projecting receivers 207 on the filter frame 213. Thus closure of the vacuum cleaner is also only possible when a filter bag 208 has been introduced.

Figure 29:
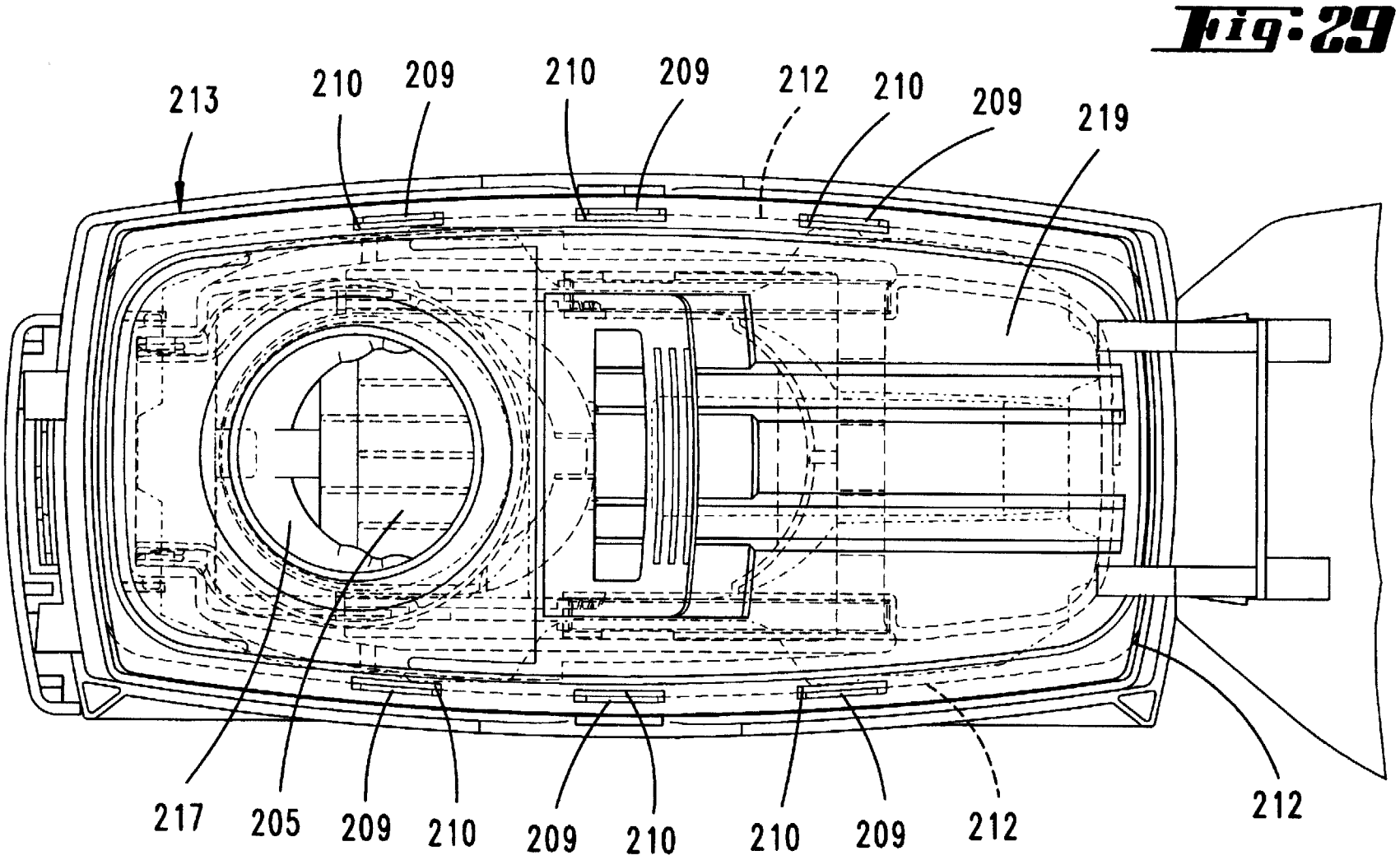
FIG. 29 is a representation corresponding to that of FIG. 28, in plan view.

In closed condition, see FIGS. 28, 29, the closure plate 219 is latched by retaining noses 209 penetrating apertures 210 in the closure plate 219. The retaining noses 209 may project from a sealing edge 212, which is provided in free standing manner at an angle 211 of the filter frame 213 at least over the longitudinal extent of the filter frame 213. In the closed condition, a peripheral sealing lip 214 on the outer side of the closure plate 219 comes into sealing abutment against the flat inner side of the sealing edge 212. Also in the case of this embodiment, as already described, a connection of the actuation projection 220 to the closure plate 219 may be effected, for example by means of a flexible, stretchable connecting means, so that in the course of compression of the actuation projection 220, simultaneous pivoting of the actuation projection 220 is initiated.

All features disclosed are relevant to the invention.

We claim:

1. Dust filter bag for a vacuum cleaner, filter bag comprising:

a mounting plate comprising a card-paper material, and a dust bag connected to the mounting plate, the mounting plate having a sealingly closable opening for receiving a suction tube of a vacuum cleaner, the mounting plate further comprising an upper layer and a lower layer which extend across the dust bag with the lower layer being located between the upper layer and the dust bag;

a closure member disposed between said upper layer and said lower layer, and being displaceable from an open disposition into a closed position for closure of said opening;

wherein said closure member is accommodated substantially completely within an outer contour of the mounting plate in a closed position and in an open dispositions;

an elongated recess is disposed in said upper layer for exposing a portion of said closure member; and said recess is separate from said opening, and a longitudinal dimension of said recess corresponds to a path of displacement of the said closure member.

2. Dust filter bag according to claim 1, wherein said mounting plate includes a third layer disposed between said upper layer and said lower layer, said lower layer providing a substantially full surface area support for the closure member in the open disposition.

3. Dust filter bag according to claim 1, wherein and edge of said closure member extends out to or beyond the edge contour of the mounting plate at least over a portion of a path of displacement of the closure member.

4. Dust filter bag according to claim 1, wherein the closure member comprises a relatively wide portion for closing said opening, and a relatively narrow handle portion extending from said wide portion beneath said recess of said upper layer.

5. Dust filter bag according to claim 1, further comprising a spade handle associated with the said recess.

6. Dust filter bag according to claim 5, further comprising a handling projection (M) provided on said spade handle.

7. Dust filter bag according to claim 5, wherein said spade handle has a section capable of being folded-out.

8. Dust filter bag according to claim 7, wherein two fold locations are provided in said spade handle section.

9. Dust filter bag for a vacuum cleaner, the filter bag comprising:

a mounting plate comprising a card-paper material, and a dust bag connected to the mounting plate, the mounting plate having a sealingly closable opening for receiving a suction tube of a vacuum cleaner, the mounting plate further comprising an upper layer and a lower layer which extend across the dust bag with the lower layer being located between the upper layer and the dust bag;

a closure member disposed between said upper layer and said lower layer, and being displaceable from an open disposition into a closed position for closure of said opening;

wherein said closure member is accommodated substantially completely within an outer contour of the mounting plate in a closed position and in an open disposition;

an elongated recess is disposed in said upper layer for exposing a portion of said closure member;

said recess is separate from said opening, and a longitudinal dimension of said recess corresponds to a path of displacement of said closure member; and a rubber seal is provided on the peripheral edge of said opening, the rubber seal projecting inwardly beyond a periphery of said opening that to provide an inwardly projecting stabilizing portion in overlapping relationship with the rubber seal.

10. Dust filter bag according to claim 9, wherein said stabilizing portion comprises a card-paper material.

11. Dust filter bag according to claim 9, wherein said stabilizing portion is provided in the form of a tongue.

12. Dust filter bag according to claim 9, wherein a dimension (e) of said stabilizing portion in an inward direction relative to a periphery of said opening corresponds to approximately one-half of the dimension (E) of the rubber seal in the inward direction.

13. Dust filter bag according to claim 9, wherein the dimension (E) of the rubber seal in the inward direction from the periphery of said opening corresponds to a range of approximately three-tenths to five-tenths of a diameter of said opening.

14. Dust filter bag according to claim 9, wherein for a multilayer construction of said mounting plate, said stabilizing portion is provided as part of a layer which is in direct contact with said rubber seal.

15. Dust filter bag according to claim 9, wherein said stabilizing portion is provided on a side of said rubber seal directed away from the dust bag.

16. Vacuum cleaner comprising:

a dust filter bag having a mounting plate with an opening for a suction connection;

wherein the mounting plate has a closure member which is automatically displaceable into a closed position in the course of opening the vacuum cleaner;

the vacuum cleaner further comprises an actuation projection (B) provided on a portion of the vacuum cleaner;

said actuation projection is operative on the closure member during opening or closing of the vacuum cleaner; and a length of the actuation projection (B) for actuation of the closure member is variable.

17. Vacuum cleaner according to claim 16, wherein the actuation projection (B) is shortened in the disposition of use of the dust filter bag upon an opening of said closure member.

18. Vacuum cleaner according to claim 16, wherein the actuation projection (B) is provided with spring-biasing in a direction of extension.

19. Vacuum cleaner according to claim 16, further comprising a drag cover (T) wherein the actuation projection (B) is disposed on said drag cover.

20. Vacuum cleaner according to claim 16, further comprising a spring disposed between said drag cover (T) and said actuation projection (B), wherein the actuation projection is pivotable against the spring.

21. Vacuum cleaner according to claim 16, wherein registration projections are provided connected to said actuation projection (B), said registration projections enter into registration openings of another portion of the vacuum cleaner upon a completion of pivoting of the actuation projection (B), whereby closure of the vacuum cleaner is only possible on entry of the registration projections.

22. Vacuum cleaner according to claim 21, wherein the actuation projection (B) further comprises a plate pivotally connected to said drag cover (T); and the registration projections are provided on said plate.

23. Vacuum cleaner according to claim 19, wherein the actuation projection is connected by a connection to said drag cover enabling a pivoting of said actuation projection in the course of compression of the actuation projection.

24. Vacuum cleaner according to claim 23, wherein the connection comprises a flexible stretchable connecting means.

25. Vacuum cleaner according to claim 23, wherein the connection is a strap.

26. Vacuum cleaner according to claim 16, wherein the actuation projection has a lateral support for abutment against a frame of a dust-bag receiving portion of the vacuum cleaner.

27. Vacuum cleaner according to claim 26, wherein said receiving portion provides a slideway on which said lateral support is slidable in the course of a closing operation of the vacuum cleaner.

28. Dust filter bag for a vacuum cleaner, the filter bag comprising:

a mounting plate comprising a card-paper material, and a dust bag connected to the mounting plate, the mounting plate having a sealingly closable opening for receiving a suction tube of a vacuum cleaner, the mounting plate further comprising an upper layer and a lower layer which extend across the dust bag with the lower layer being located between the upper layer and the dust bag;

a closure member disposed between said upper layer and said lower layer, and being displaceable from an open disposition into a closed position for closure of said opening; and a rubber seal is provided on the peripheral edge of said opening, the rubber seal projecting inwardly beyond a periphery of said opening to provide an inwardly projecting stabilizing portion in overlapping relationship with the rubber seal.

* * * * *